US007453477B2

(12) United States Patent
Kamiyamaguchi et al.

(10) Patent No.: US 7,453,477 B2
(45) Date of Patent: Nov. 18, 2008

(54) DRIVING DEVICE FOR A DISPLAY PANEL

(75) Inventors: Jun Kamiyamaguchi, Yamanashi-ken (JP); Masahiro Suzuki, Yamanashi-ken (JP); Tetsuya Shigeta, Yamanashi-ken (JP); Hirofumi Honda, Tokyo (JP); Tetsuro Nagakubo, Tokyo (JP)

(73) Assignee: Pioneer Corporation, Tokyo (JP)

( * ) Notice: Subject to any disclaimer, the term of this patent is extended or adjusted under 35 U.S.C. 154(b) by 967 days.

(21) Appl. No.: 10/868,185

(22) Filed: Jun. 16, 2004

(65) Prior Publication Data

US 2005/0024350 A1 Feb. 3, 2005

(30) Foreign Application Priority Data

Jun. 23, 2003 (JP) ..... 2003-178113

(51) Int. Cl.
*G09G 5/10* (2006.01)

(52) U.S. Cl. ..... 345/692; 345/63

(58) Field of Classification Search ..... 345/60, 345/63, 690, 691, 693
See application file for complete search history.

(56) References Cited

U.S. PATENT DOCUMENTS 6,621,474 B2 * 9/2003 Nagakubo et al. ..... 345/60
6,710,755 B1 * 3/2004 Shiozaki et al. ..... 345/60
6,747,616 B2 * 6/2004 Honda et al. ..... 345/63
2002/0018030 A1 2/2002 Shigeta et al.
2002/0018031 A1 * 2/2002 Nakamura et al. ..... 345/60
2002/0054002 A1 5/2002 Tokunaga et al.

FOREIGN PATENT DOCUMENTS

| | | |
|---|---|---|
| EP | 1 450 337 | 8/2004 |
| EP | 1 494 198 | 1/2005 |
| EP | 1 494 199 | 1/2005 |
| EP | 1 496 493 | 1/2005 |
| JP | 2000-227778 | 8/2000 |

* cited by examiner

*Primary Examiner*—Ricardo L Osorio
(74) *Attorney, Agent, or Firm*—Drinker Biddle & Reath LLP

(57) ABSTRACT

An improved driving device for a display panel. In the display panel, pixel cells serving as pixels are positioned in a plurality of display lines. The driving device drives the display panel according to pixel data derived from an input image signal. The display lines are divided into a plurality of display line groups, and each group includes a plurality of neighboring display lines. The driving device has a light emission driving circuit. This circuit causes the pixel cells in each of the neighboring display lines in the respective display line groups to emit light at different brightness levels based on weighting values assigned to the display lines. The weighting values are assigned to the display lines such that bias in brightness differences between the pixel cells positioned in neighboring display lines falls within a prescribed range for all neighboring display lines in the display panel.

5 Claims, 18 Drawing Sheets

FIG. 2

SELECTIVE ERASE

| Ds | HD | | | | | | | | | | | | | | LIGHT EMISSION DRIVING PATTERN IN ONE FIELD | | | | | | | | | | | | | | LIGHT EMISSION BRIGHTNESS |
|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLES: SELECTIVE ERASE DISCHARGE
WHITE CIRCLES: LIGHT DISCHARGE

FIG. 5

| CONVERSION TABLE | |
|---|---|
| MD | GD<br>0 1 2 3 |
| 000 | 1 0 0 0 |
| 001 | 0 1 0 0 |
| 010 | 0 0 1 0 |
| 011 | 0 0 0 1 |
| 100 | 0 0 0 0 |

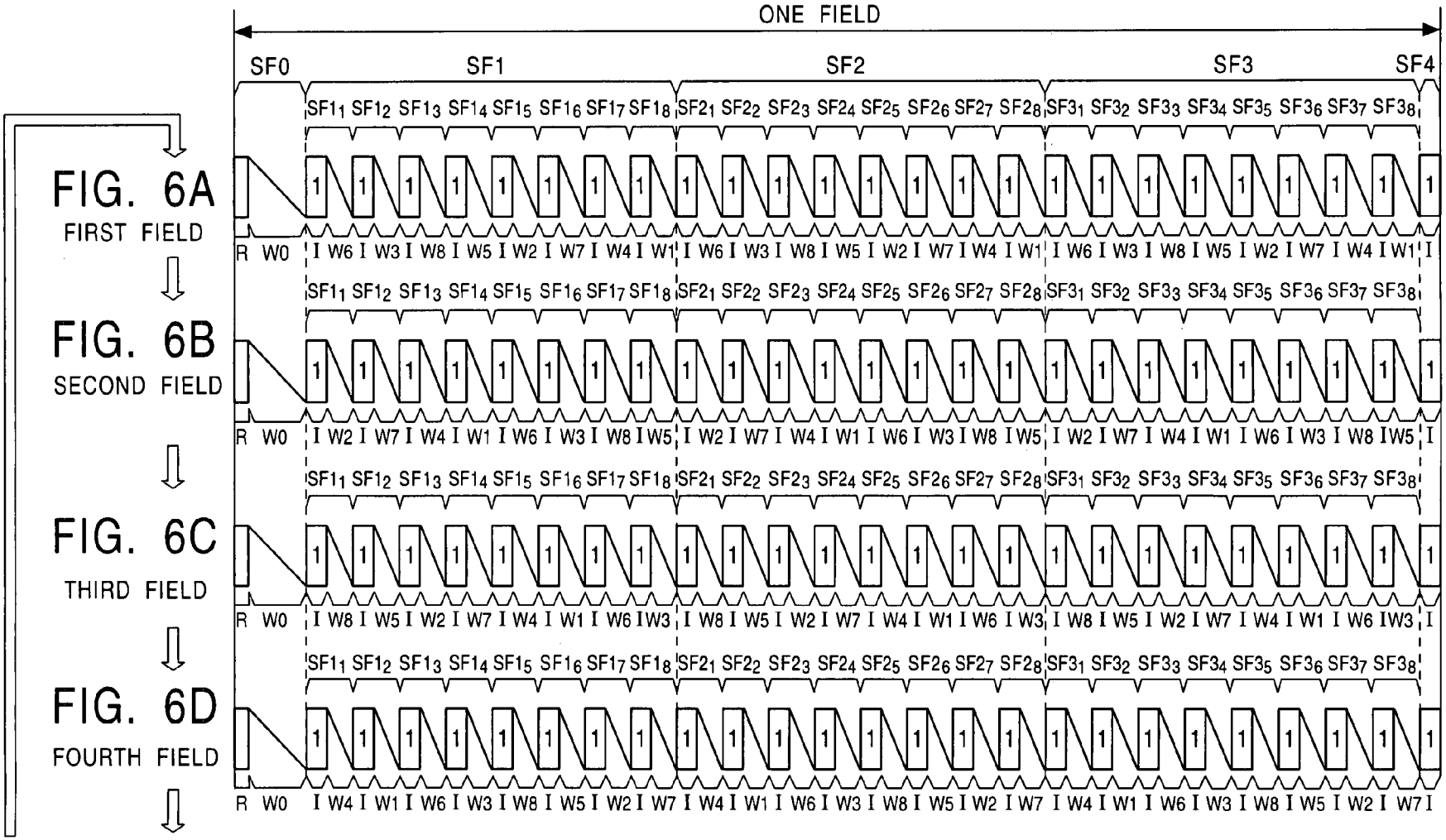
FIG. 6A FIRST FIELD
FIG. 6B SECOND FIELD
FIG. 6C THIRD FIELD
FIG. 6D FOURTH FIELD

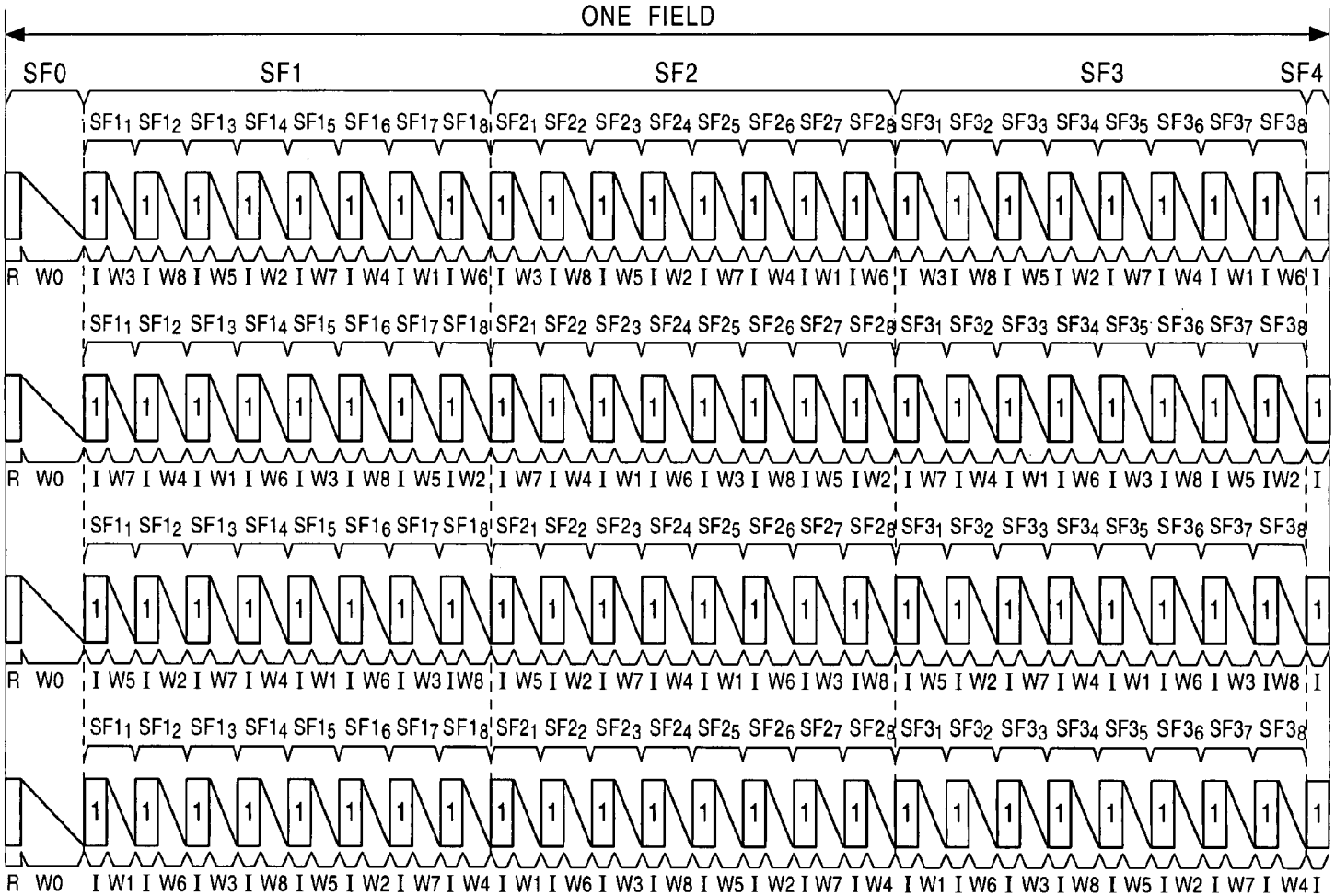
FIG. 6E FIFTH FIELD
FIG. 6F SIXTH FIELD
FIG. 6G SEVENTH FIELD
FIG. 6H EIGHTH FIELD

FIG. 7

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHTNESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ○ | ○ | ○ | ◉ | | | | | | | | | | | | | | | | | | 8 |
| | 8N-6 | | ○ | ○ | ○ | ○ | ◉ | | | | | | | | | | | | | | | | | | | | | 5 |
| | 8N-5 | | ○ | ◉ | | | | | | | | | | | | | | | | | | | | | | | | 2 |
| | 8N-4 | | ○ | ○ | ○ | ○ | ○ | ○ | ◉ | | | | | | | | | | | | | | | | | | | 7 |
| | 8N-3 | | ○ | ○ | ○ | ◉ | | | | | | | | | | | | | | | | | | | | | | 4 |
| | 8N-2 | | ◉ | | | | | | | | | | | | | | | | | | | | | | | | | 1 |
| | 8N-1 | | ○ | ○ | ○ | ○ | ○ | ◉ | | | | | | | | | | | | | | | | | | | | 6 |
| | 8N | | ○ | ○ | ◉ | | | | | | | | | | | | | | | | | | | | | | | 3 |
| 0 0 1 0 | 8N-7 | | ○ | ○ | ○ | ○ | ○ | ○ | ○ | ○ | ○ | ○ | ○ | ○ | ○ | ○ | ○ | ◉ | | | | | | | | | | 16 |
| | 8N-6 | | ○ | ○ | ○ | ○ | ○ | ○ | ○ | ○ | ○ | ○ | ○ | ○ | ◉ | | | | | | | | | | | | | 13 |
| | 8N-5 | | ○ | ○ | ○ | ○ | ○ | ○ | ○ | ○ | ○ | ◉ | | | | | | | | | | | | | | | | 10 |
| | 8N-4 | | ○ | ○ | ○ | ○ | ○ | ○ | ○ | ○ | ○ | ○ | ○ | ○ | ○ | ○ | ◉ | | | | | | | | | | | 15 |
| | 8N-3 | | ○ | ○ | ○ | ○ | ○ | ○ | ○ | ○ | ○ | ○ | ○ | ◉ | | | | | | | | | | | | | | 12 |
| | 8N-2 | | ○ | ○ | ○ | ○ | ○ | ○ | ○ | ○ | ◉ | | | | | | | | | | | | | | | | | 9 |
| | 8N-1 | | ○ | ○ | ○ | ○ | ○ | ○ | ○ | ○ | ○ | ○ | ○ | ○ | ○ | ◉ | | | | | | | | | | | | 14 |
| | 8N | | ○ | ○ | ○ | ○ | ○ | ○ | ○ | ○ | ○ | ○ | ◉ | | | | | | | | | | | | | | | 11 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N-5 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-2 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 8

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHTNESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ◉ | | | | | | | | | | | | | | | | | | | | | | 4 |
| | 8N-6 | | ◉ | | | | | | | | | | | | | | | | | | | | | | | | | 1 |
| | 8N-5 | | ○ | ○ | ○ | ○ | ○ | ◉ | | | | | | | | | | | | | | | | | | | | 6 |
| | 8N-4 | | ○ | ○ | ◉ | | | | | | | | | | | | | | | | | | | | | | | 3 |
| | 8N-3 | | ○ | ○ | ○ | ○ | ○ | ○ | ○ | ◉ | | | | | | | | | | | | | | | | | | 8 |
| | 8N-2 | | ○ | ○ | ○ | ○ | ◉ | | | | | | | | | | | | | | | | | | | | | 5 |
| | 8N-1 | | ○ | ◉ | | | | | | | | | | | | | | | | | | | | | | | | 2 |
| | 8N | | ○ | ○ | ○ | ○ | ○ | ○ | ◉ | | | | | | | | | | | | | | | | | | | 7 |
| 0 0 1 0 | 8N-7 | | ○ | ○ | ○ | ○ | ○ | ○ | ○ | ○ | ○ | ○ | ○ | ◉ | | | | | | | | | | | | | | 12 |
| | 8N-6 | | ○ | ○ | ○ | ○ | ○ | ○ | ○ | ○ | ◉ | | | | | | | | | | | | | | | | | 9 |
| | 8N-5 | | ○ | ○ | ○ | ○ | ○ | ○ | ○ | ○ | ○ | ○ | ○ | ○ | ○ | ◉ | | | | | | | | | | | | 14 |
| | 8N-4 | | ○ | ○ | ○ | ○ | ○ | ○ | ○ | ○ | ○ | ○ | ◉ | | | | | | | | | | | | | | | 11 |
| | 8N-3 | | ○ | ○ | ○ | ○ | ○ | ○ | ○ | ○ | ○ | ○ | ○ | ○ | ○ | ○ | ○ | ◉ | | | | | | | | | | 16 |
| | 8N-2 | | ○ | ○ | ○ | ○ | ○ | ○ | ○ | ○ | ○ | ○ | ○ | ○ | ◉ | | | | | | | | | | | | | 13 |
| | 8N-1 | | ○ | ○ | ○ | ○ | ○ | ○ | ○ | ○ | ○ | ◉ | | | | | | | | | | | | | | | | 10 |
| | 8N | | ○ | ○ | ○ | ○ | ○ | ○ | ○ | ○ | ○ | ○ | ○ | ○ | ○ | ○ | ◉ | | | | | | | | | | | 15 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-6 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-4 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N-1 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 9

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHT-NESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ○ | ◉ | | | | | | | | | | | | | | | | | | | | 6 |
| | 8N-6 | | ○ | ○ | ◉ | | | | | | | | | | | | | | | | | | | | | | | 3 |
| | 8N-5 | | ○ | ○ | ○ | ○ | ○ | ○ | ○ | ◉ | | | | | | | | | | | | | | | | | | 8 |
| | 8N-4 | | ○ | ○ | ○ | ○ | ◉ | | | | | | | | | | | | | | | | | | | | | 5 |
| | 8N-3 | | ○ | ◉ | | | | | | | | | | | | | | | | | | | | | | | | 2 |
| | 8N-2 | | ○ | ○ | ○ | ○ | ○ | ○ | ◉ | | | | | | | | | | | | | | | | | | | 7 |
| | 8N-1 | | ○ | ○ | ○ | ◉ | | | | | | | | | | | | | | | | | | | | | | 4 |
| | 8N | | ◉ | | | | | | | | | | | | | | | | | | | | | | | | | 1 |
| 0 0 1 0 | 8N-7 | | ○ | ○ | ○ | ○ | ○ | ○ | ○ | ○ | ○ | ○ | ○ | ○ | ○ | ◉ | | | | | | | | | | | | 14 |
| | 8N-6 | | ○ | ○ | ○ | ○ | ○ | ○ | ○ | ○ | ○ | ○ | ◉ | | | | | | | | | | | | | | | 11 |
| | 8N-5 | | ○ | ○ | ○ | ○ | ○ | ○ | ○ | ○ | ○ | ○ | ○ | ○ | ○ | ○ | ○ | ◉ | | | | | | | | | | 16 |
| | 8N-4 | | ○ | ○ | ○ | ○ | ○ | ○ | ○ | ○ | ○ | ○ | ○ | ○ | ◉ | | | | | | | | | | | | | 13 |
| | 8N-3 | | ○ | ○ | ○ | ○ | ○ | ○ | ○ | ○ | ○ | ◉ | | | | | | | | | | | | | | | | 10 |
| | 8N-2 | | ○ | ○ | ○ | ○ | ○ | ○ | ○ | ○ | ○ | ○ | ○ | ○ | ○ | ○ | ◉ | | | | | | | | | | | 15 |
| | 8N-1 | | ○ | ○ | ○ | ○ | ○ | ○ | ○ | ○ | ○ | ○ | ○ | ◉ | | | | | | | | | | | | | | 12 |
| | 8N | | ○ | ○ | ○ | ○ | ○ | ○ | ○ | ○ | ◉ | | | | | | | | | | | | | | | | | 9 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-6 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N-3 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N | | ○ | ○ | ○ | ○ | ○ | ○ | ○ | ○ | ○ | ○ | ○ | ○ | ○ | ○ | ○ | ○ | ◉ | | | | | | | | | 17 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 10

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHT-NESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ◉ | | | | | | | | | | | | | | | | | | | | | | | | 2 |
| | 8N-6 | | ○ | ○ | ○ | ○ | ○ | ○ | ◉ | | | | | | | | | | | | | | | | | | | 7 |
| | 8N-5 | | ○ | ○ | ○ | ◉ | | | | | | | | | | | | | | | | | | | | | | 4 |
| | 8N-4 | | ◉ | | | | | | | | | | | | | | | | | | | | | | | | | 1 |
| | 8N-3 | | ○ | ○ | ○ | ○ | ○ | ◉ | | | | | | | | | | | | | | | | | | | | 6 |
| | 8N-2 | | ○ | ○ | ◉ | | | | | | | | | | | | | | | | | | | | | | | 3 |
| | 8N-1 | | ○ | ○ | ○ | ○ | ○ | ○ | ○ | ◉ | | | | | | | | | | | | | | | | | | 8 |
| | 8N | | ○ | ○ | ○ | ○ | ◉ | | | | | | | | | | | | | | | | | | | | | 5 |
| 0 0 1 0 | 8N-7 | | ○ | ○ | ○ | ○ | ○ | ○ | ○ | ○ | ○ | ◉ | | | | | | | | | | | | | | | | 10 |
| | 8N-6 | | ○ | ○ | ○ | ○ | ○ | ○ | ○ | ○ | ○ | ○ | ○ | ○ | ○ | ○ | ◉ | | | | | | | | | | | 15 |
| | 8N-5 | | ○ | ○ | ○ | ○ | ○ | ○ | ○ | ○ | ○ | ○ | ○ | ◉ | | | | | | | | | | | | | | 12 |
| | 8N-4 | | ○ | ○ | ○ | ○ | ○ | ○ | ○ | ○ | ◉ | | | | | | | | | | | | | | | | | 9 |
| | 8N-3 | | ○ | ○ | ○ | ○ | ○ | ○ | ○ | ○ | ○ | ○ | ○ | ○ | ○ | ◉ | | | | | | | | | | | | 14 |
| | 8N-2 | | ○ | ○ | ○ | ○ | ○ | ○ | ○ | ○ | ○ | ○ | ◉ | | | | | | | | | | | | | | | 11 |
| | 8N-1 | | ○ | ○ | ○ | ○ | ○ | ○ | ○ | ○ | ○ | ○ | ○ | ○ | ○ | ○ | ○ | ◉ | | | | | | | | | | 16 |
| | 8N | | ○ | ○ | ○ | ○ | ○ | ○ | ○ | ○ | ○ | ○ | ○ | ○ | ◉ | | | | | | | | | | | | | 13 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-4 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-2 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 11

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHTNESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ○ | ○ | ◉ | | | | | | | | | | | | | | | | | | | 7 |
| | 8N-6 | | ○ | ○ | ○ | ◉ | | | | | | | | | | | | | | | | | | | | | | 4 |
| | 8N-5 | | ◉ | | | | | | | | | | | | | | | | | | | | | | | | | 1 |
| | 8N-4 | | ○ | ○ | ○ | ○ | ○ | ◉ | | | | | | | | | | | | | | | | | | | | 6 |
| | 8N-3 | | ○ | ○ | ◉ | | | | | | | | | | | | | | | | | | | | | | | 3 |
| | 8N-2 | | ○ | ○ | ○ | ○ | ○ | ○ | ◉ | | | | | | | | | | | | | | | | | | | 8 |
| | 8N-1 | | ○ | ○ | ○ | ○ | ◉ | | | | | | | | | | | | | | | | | | | | | 5 |
| | 8N | | ○ | ◉ | | | | | | | | | | | | | | | | | | | | | | | | 2 |
| 0 0 1 0 | 8N-7 | | ○ | ○ | ○ | ○ | ○ | ○ | ○ | ○ | ○ | ○ | ○ | ○ | ○ | ○ | ◉ | | | | | | | | | | | 15 |
| | 8N-6 | | ○ | ○ | ○ | ○ | ○ | ○ | ○ | ○ | ○ | ○ | ○ | ◉ | | | | | | | | | | | | | | 12 |
| | 8N-5 | | ○ | ○ | ○ | ○ | ○ | ○ | ○ | ○ | ◉ | | | | | | | | | | | | | | | | | 9 |
| | 8N-4 | | ○ | ○ | ○ | ○ | ○ | ○ | ○ | ○ | ○ | ○ | ○ | ○ | ○ | ◉ | | | | | | | | | | | | 14 |
| | 8N-3 | | ○ | ○ | ○ | ○ | ○ | ○ | ○ | ○ | ○ | ○ | ◉ | | | | | | | | | | | | | | | 11 |
| | 8N-2 | | ○ | ○ | ○ | ○ | ○ | ○ | ○ | ○ | ○ | ○ | ○ | ○ | ○ | ○ | ○ | ◉ | | | | | | | | | | 16 |
| | 8N-1 | | ○ | ○ | ○ | ○ | ○ | ○ | ○ | ○ | ○ | ○ | ○ | ○ | ◉ | | | | | | | | | | | | | 13 |
| | 8N | | ○ | ○ | ○ | ○ | ○ | ○ | ○ | ○ | ○ | ◉ | | | | | | | | | | | | | | | | 10 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-5 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-3 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N | | ○ | ○ | ○ | ○ | ○ | ○ | ○ | ○ | ○ | ○ | ○ | ○ | ○ | ○ | ○ | ○ | ○ | ◉ | | | | | | | | 18 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 12

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHT-NESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ◉ | | | | | | | | | | | | | | | | | | | | | | | 3 |
| | 8N-6 | | ○ | ○ | ○ | ○ | ○ | ○ | ○ | ◉ | | | | | | | | | | | | | | | | | | 8 |
| | 8N-5 | | ○ | ○ | ○ | ○ | ◉ | | | | | | | | | | | | | | | | | | | | | 5 |
| | 8N-4 | | ○ | ◉ | | | | | | | | | | | | | | | | | | | | | | | | 2 |
| | 8N-3 | | ○ | ○ | ○ | ○ | ○ | ○ | ◉ | | | | | | | | | | | | | | | | | | | 7 |
| | 8N-2 | | ○ | ○ | ○ | ◉ | | | | | | | | | | | | | | | | | | | | | | 4 |
| | 8N-1 | | ◉ | | | | | | | | | | | | | | | | | | | | | | | | | 1 |
| | 8N | | ○ | ○ | ○ | ○ | ○ | ◉ | | | | | | | | | | | | | | | | | | | | 6 |
| 0 0 1 0 | 8N-7 | | ○ | ○ | ○ | ○ | ○ | ○ | ○ | ○ | ○ | ○ | ◉ | | | | | | | | | | | | | | | 11 |
| | 8N-6 | | ○ | ○ | ○ | ○ | ○ | ○ | ○ | ○ | ○ | ○ | ○ | ○ | ○ | ○ | ○ | ◉ | | | | | | | | | | 16 |
| | 8N-5 | | ○ | ○ | ○ | ○ | ○ | ○ | ○ | ○ | ○ | ○ | ○ | ○ | ◉ | | | | | | | | | | | | | 13 |
| | 8N-4 | | ○ | ○ | ○ | ○ | ○ | ○ | ○ | ○ | ○ | ◉ | | | | | | | | | | | | | | | | 10 |
| | 8N-3 | | ○ | ○ | ○ | ○ | ○ | ○ | ○ | ○ | ○ | ○ | ○ | ○ | ○ | ○ | ◉ | | | | | | | | | | | 15 |
| | 8N-2 | | ○ | ○ | ○ | ○ | ○ | ○ | ○ | ○ | ○ | ○ | ○ | ◉ | | | | | | | | | | | | | | 12 |
| | 8N-1 | | ○ | ○ | ○ | ○ | ○ | ○ | ○ | ○ | ◉ | | | | | | | | | | | | | | | | | 9 |
| | 8N | | ○ | ○ | ○ | ○ | ○ | ○ | ○ | ○ | ○ | ○ | ○ | ○ | ○ | ◉ | | | | | | | | | | | | 14 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N-4 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-1 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 13

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHT-NESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ◉ | | | | | | | | | | | | | | | | | | | | | 5 |
| | 8N-6 | | ○ | ◉ | | | | | | | | | | | | | | | | | | | | | | | | 2 |
| | 8N-5 | | ○ | ○ | ○ | ○ | ○ | ○ | ◉ | | | | | | | | | | | | | | | | | | | 7 |
| | 8N-4 | | ○ | ○ | ○ | ◉ | | | | | | | | | | | | | | | | | | | | | | 4 |
| | 8N-3 | | ◉ | | | | | | | | | | | | | | | | | | | | | | | | | 1 |
| | 8N-2 | | ○ | ○ | ○ | ○ | ○ | ◉ | | | | | | | | | | | | | | | | | | | | 6 |
| | 8N-1 | | ○ | ○ | ◉ | | | | | | | | | | | | | | | | | | | | | | | 3 |
| | 8N | | ○ | ○ | ○ | ○ | ○ | ○ | ○ | ◉ | | | | | | | | | | | | | | | | | | 8 |
| 0 0 1 0 | 8N-7 | | ○ | ○ | ○ | ○ | ○ | ○ | ○ | ○ | ○ | ○ | ○ | ○ | ◉ | | | | | | | | | | | | | 13 |
| | 8N-6 | | ○ | ○ | ○ | ○ | ○ | ○ | ○ | ○ | ○ | ◉ | | | | | | | | | | | | | | | | 10 |
| | 8N-5 | | ○ | ○ | ○ | ○ | ○ | ○ | ○ | ○ | ○ | ○ | ○ | ○ | ○ | ○ | ◉ | | | | | | | | | | | 15 |
| | 8N-4 | | ○ | ○ | ○ | ○ | ○ | ○ | ○ | ○ | ○ | ○ | ○ | ◉ | | | | | | | | | | | | | | 12 |
| | 8N-3 | | ○ | ○ | ○ | ○ | ○ | ○ | ○ | ○ | ◉ | | | | | | | | | | | | | | | | | 9 |
| | 8N-2 | | ○ | ○ | ○ | ○ | ○ | ○ | ○ | ○ | ○ | ○ | ○ | ○ | ○ | ◉ | | | | | | | | | | | | 14 |
| | 8N-1 | | ○ | ○ | ○ | ○ | ○ | ○ | ○ | ○ | ○ | ○ | ◉ | | | | | | | | | | | | | | | 11 |
| | 8N | | ○ | ○ | ○ | ○ | ○ | ○ | ○ | ○ | ○ | ○ | ○ | ○ | ○ | ○ | ○ | ◉ | | | | | | | | | | 16 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N-6 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-3 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-1 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 14

| PIXEL DRIVING DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | BRIGHTNESS |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ⊙ | | | | | | | | | | | | | | | | | | | | | | | | | 1 |
| | 8N-6 | | ○ | ○ | ○ | ○ | ○ | ⊙ | | | | | | | | | | | | | | | | | | | | 6 |
| | 8N-5 | | ○ | ○ | ⊙ | | | | | | | | | | | | | | | | | | | | | | | 3 |
| | 8N-4 | | ○ | ○ | ○ | ○ | ○ | ○ | ○ | ⊙ | | | | | | | | | | | | | | | | | | 8 |
| | 8N-3 | | ○ | ○ | ○ | ○ | ⊙ | | | | | | | | | | | | | | | | | | | | | 5 |
| | 8N-2 | | ○ | ⊙ | | | | | | | | | | | | | | | | | | | | | | | | 2 |
| | 8N-1 | | ○ | ○ | ○ | ○ | ○ | ○ | ⊙ | | | | | | | | | | | | | | | | | | | 7 |
| | 8N | | ○ | ○ | ○ | ⊙ | | | | | | | | | | | | | | | | | | | | | | 4 |
| 0 0 1 0 | 8N-7 | | ○ | ○ | ○ | ○ | ○ | ○ | ○ | ○ | ⊙ | | | | | | | | | | | | | | | | | 9 |
| | 8N-6 | | ○ | ○ | ○ | ○ | ○ | ○ | ○ | ○ | ○ | ○ | ○ | ○ | ○ | ⊙ | | | | | | | | | | | | 14 |
| | 8N-5 | | ○ | ○ | ○ | ○ | ○ | ○ | ○ | ○ | ○ | ○ | ⊙ | | | | | | | | | | | | | | | 11 |
| | 8N-4 | | ○ | ○ | ○ | ○ | ○ | ○ | ○ | ○ | ○ | ○ | ○ | ○ | ○ | ○ | ○ | ⊙ | | | | | | | | | | 16 |
| | 8N-3 | | ○ | ○ | ○ | ○ | ○ | ○ | ○ | ○ | ○ | ○ | ○ | ○ | ⊙ | | | | | | | | | | | | | 13 |
| | 8N-2 | | ○ | ○ | ○ | ○ | ○ | ○ | ○ | ○ | ○ | ⊙ | | | | | | | | | | | | | | | | 10 |
| | 8N-1 | | ○ | ○ | ○ | ○ | ○ | ○ | ○ | ○ | ○ | ○ | ○ | ○ | ○ | ○ | ⊙ | | | | | | | | | | | 15 |
| | 8N | | ○ | ○ | ○ | ○ | ○ | ○ | ○ | ○ | ○ | ○ | ○ | ⊙ | | | | | | | | | | | | | | 12 |
| 0 0 0 1 | 8N-7 | | ○ | ○ | ○ | ○ | ○ | ○ | ○ | ○ | ○ | ○ | ○ | ○ | ○ | ○ | ○ | ○ | ⊙ | | | | | | | | | 17 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | 22 |
| | 8N-5 | | ○ | ○ | ○ | ○ | ○ | ○ | ○ | ○ | ○ | ○ | ○ | ○ | ○ | ○ | ○ | ○ | ○ | ○ | ⊙ | | | | | | | 19 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | 24 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ⊙ | | | | | 21 |
| | 8N-2 | | ○ | ○ | ○ | ○ | ○ | ○ | ○ | ○ | ○ | ○ | ○ | ○ | ○ | ○ | ○ | ○ | ○ | ⊙ | | | | | | | | 18 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ⊙ | | | 23 |
| | 8N | | ○ | ○ | ○ | ○ | ○ | ○ | ○ | ○ | ○ | ○ | ○ | ○ | ○ | ○ | ○ | ○ | ○ | ○ | ○ | ⊙ | | | | | | 20 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

DRIVING DEVICE FOR A DISPLAY PANEL

BACKGROUND OF THE INVENTION

1. Field of the Invention

This invention relates to a driving device for a display panel in which pixel cells acting as pixels are positioned on each display line.

2. Description of the Related Art

Recently much attention has been paid to plasma display panels (hereafter called "PDPs") as two-dimensional image display panels. In general, the PDP has a plurality of discharge cells arranged in a matrix form. The subfield method is also known as a driving method to cause the PDP to display an image corresponding to an input image signal. In the subfield method, a display period for one field is divided into a plurality of subfields, and each discharge cell is selectively caused to discharge and emit light in each subfield according to the brightness level expressed by the input image signal. By this means, an intermediate brightness is perceived according to the total light emission period within the whole display period of the field concerned.

FIG. 1 of the accompanying drawings shows one example of a light emission driving sequence based on this subfield method, which is disclosed in FIG. 14 of Japanese Patent Kokai (Laid-open Publication) No. 2000-227778).

In the light emission driving sequence shown in FIG. 1 of the accompanying drawings of this application, one field period is divided into 14 subfields, which are subfields SF1 to SF14. All discharge cells of the PDP are initialized to the lit mode ($R_c$) only in the leading subfield SF1 of the subfields SF1 to SF14. In each of the subfields SF1 to SF14, discharge cells are selectively set to the extinguished mode (unlit mode) ($W_c$) according to the input image signal, and only those discharge cells which are still in the lit mode are caused to discharge and emit light over the period allocated to the subfield concerned ($I_c$).

FIG. 2 of the accompanying drawings shows one example of a light emission driving pattern in one field period, in which each discharge cell is driven based on the light emission driving sequence described above and shown in FIG. 1 of the accompanying drawings (see for example FIG. 27 of Japanese Patent Kokai No. 2000-227778).

In the light emission pattern shown in FIG. 2 of the accompanying drawings of the instant application, each discharge cell which is initialized to the lit mode in the leading subfield SF1 is set to the extinguished mode during one of the subfields SF1 to SF14, as indicated by a black circle. Once the discharge cell is set to the extinguished mode, that discharge cell does not return to the lit mode until the one field period finishes. Hence during the period until the extinguished mode is set, the discharge cell continues the discharging and light emission in the subfields, as indicated by the white circles. Here, the total light emission period in one field period is different for each of the 15 light emission patterns shown in FIG. 2, so that 15 intermediate brightnesses are expressed; that is, intermediate brightnesses can be expressed for (N+1) gray scales (where N is the number of subfields).

However, because in this driving method there is a limit to the number of subfields into which one field can be divided, the number of gray scales is inadequate. In order to mitigate the insufficient number of gray scales, multi-grayscale processing, such as error diffusion and dither processing, is applied to the input image signal.

In the error diffusion processing, each pixel of the input image signal is converted for example into 8-bit pixel data, and the upper 6 bits are taken to be display data while the remaining lower 2 bits are regarded as error data. The result of weighted addition of the error data in the pixel data of the surrounding pixels is then reflected in the display data. Through this operation, the brightness of the lower 2 bits of the original pixel is pseudo-represented by the surrounding pixels, and consequently only 6 bits of display data, fewer than the original 8 bits, can represent brightness grayscales equivalently to the 8 bits of pixel data. Then, the 6 bits of error-diffused pixel data obtained by this error diffusion processing are subjected to dither processing. In dither processing, a plurality of neighboring pixels are regarded as one pixel unit, and dither coefficients consisting of different coefficient values are allocated and added to the error-diffused pixel data corresponding to the pixels within one pixel unit respectively. By means of addition of these dither coefficients, when the one pixel unit is viewed, brightness equivalent to 8 bits can be represented using only the upper 4 bits of the dither-added pixel data. Therefore, the upper 4 bits of the dither-added pixel data are extracted and used as multi-grayscale pixel data PDs, so as to allocate these pixel data PDs to the 15 light emission patterns, as shown in FIG. 2, respectively.

However, if dither coefficients are added regularly to pixel data in dither processing, pseudo-patterns not related to the input image signal, i.e., so-called dither patterns, are sometimes perceived. This detracts from the image quality.

SUMMARY OF THE INVENTION

One object of this invention is to provide a driving device for a display panel enabling satisfactory image display with dither patterns suppressed.

According to one aspect of the present invention, there is provided an improved driving device for a display panel. In the display panel, pixel cells serving as pixels are positioned in a plurality of display lines. The driving device drives the display panel according to pixel data derived from an input image signal. The display lines are divided into a plurality of display line groups, and each group includes a plurality of neighboring display lines. The driving device has a light emission driving circuit. This circuit causes the pixel cells in each of the neighboring display lines in the respective display line groups to emit light at different brightness levels based on weighting values assigned to the display lines. The weighting values are assigned to the display lines such that bias in brightness differences between the pixel cells positioned in neighboring display lines falls within a prescribed range for all neighboring display lines in the display panel.

According to another aspect of the present invention, there is provided a method of grayscale-driving a display panel based on pixel data derived from an input image signal. The display panel includes a plurality of display lines, with a plurality of pixel cells serving as pixels being arranged on each display line. The display lines are divided into L groups by taking every L display lines. Each single field display period of the input image signal is divided into a plurality of subfields. The grayscale-driving method includes setting the subfields into a lit mode and an unlit mode in K different manners so as to define first to Kth grayscale driving levels. Each grayscale driving level includes L brightness levels so that different brightness levels can be allocated to the display lines belonging to the respective display line groups for every grayscale driving level. The display panel is operated in accordance with the first to Kth grayscale driving levels.

According to still another aspect of the present invention, there is provided another method of grayscale—driving a display panel based on pixel data derived from an input image signal. The display panel includes a plurality of display lines, with a plurality of pixel cells serving as pixels being arranged on each display line. The display lines are divided into a plurality of groups, each display line group consisting of a predetermined number of neighboring display lines. Each single field display period of the input image signal is divided into a plurality of subfields. The grayscale-driving method includes setting the subfields into a lit mode and an unlit mode in K different manners so as to define first to Kth grayscale driving levels. Each grayscale driving level includes the same number of brightness levels as the number of display lines in each display line group so that different brightness levels can be allocated to the display lines in the display line group for every grayscale driving level. The display panel is operated in accordance with the first to Kth grayscale driving levels.

These and other objects, aspects and advantages of the present invention will become apparent to those skilled in the art from the following detailed description and appended claims when read and understood in conjunction with the accompanying drawings.

BRIEF DESCRIPTION OF THE DRAWINGS

FIG. 2 shows an example of a light emission driving pattern within one field period for each discharge cell driven based on the light emission driving sequence shown in FIG. 1;

FIG. 5 shows a data conversion table in a driving data conversion circuit shown in FIG. 3;

FIG. 6A through FIG. 6H show examples of the light emission driving sequences in the first field through the eighth field;

FIG. 7 shows the light emission driving pattern based on the light emission driving sequence shown in FIG. 6A;

FIG. 8 shows the light emission driving pattern based on the light emission driving sequence shown in FIG. 6B;

FIG. 9 shows the light emission driving pattern based on the light emission driving sequence shown in FIG. 6C;

FIG. 10 shows the light emission driving pattern based on the light emission driving sequence shown in FIG. 6D;

FIG. 11 shows the light emission driving pattern based on the light emission driving sequence shown in FIG. 6E;

FIG. 12 shows the light emission driving pattern based on the light emission driving sequence shown in FIG. 6F;

FIG. 13 shows the light emission driving pattern based on the light emission driving sequence shown in FIG. 6G;

FIG. 14 shows the light emission driving pattern based on the light emission driving sequence shown in FIG. 6H;

DETAILED DESCRIPTION OF THE INVENTION

Embodiments of the present invention will be described referring to FIG. 3 to FIG. 17 of the accompanying drawings.

Figure 1:
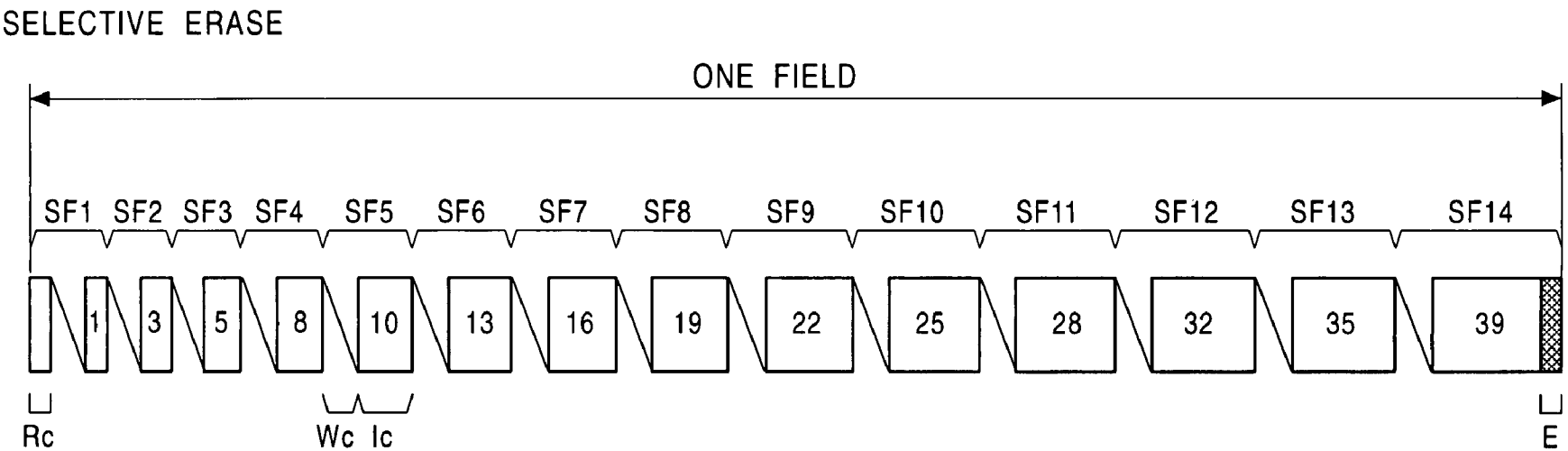
FIG. 1 shows an example of a light emission driving sequence based on the subfield method.
Figure 3:
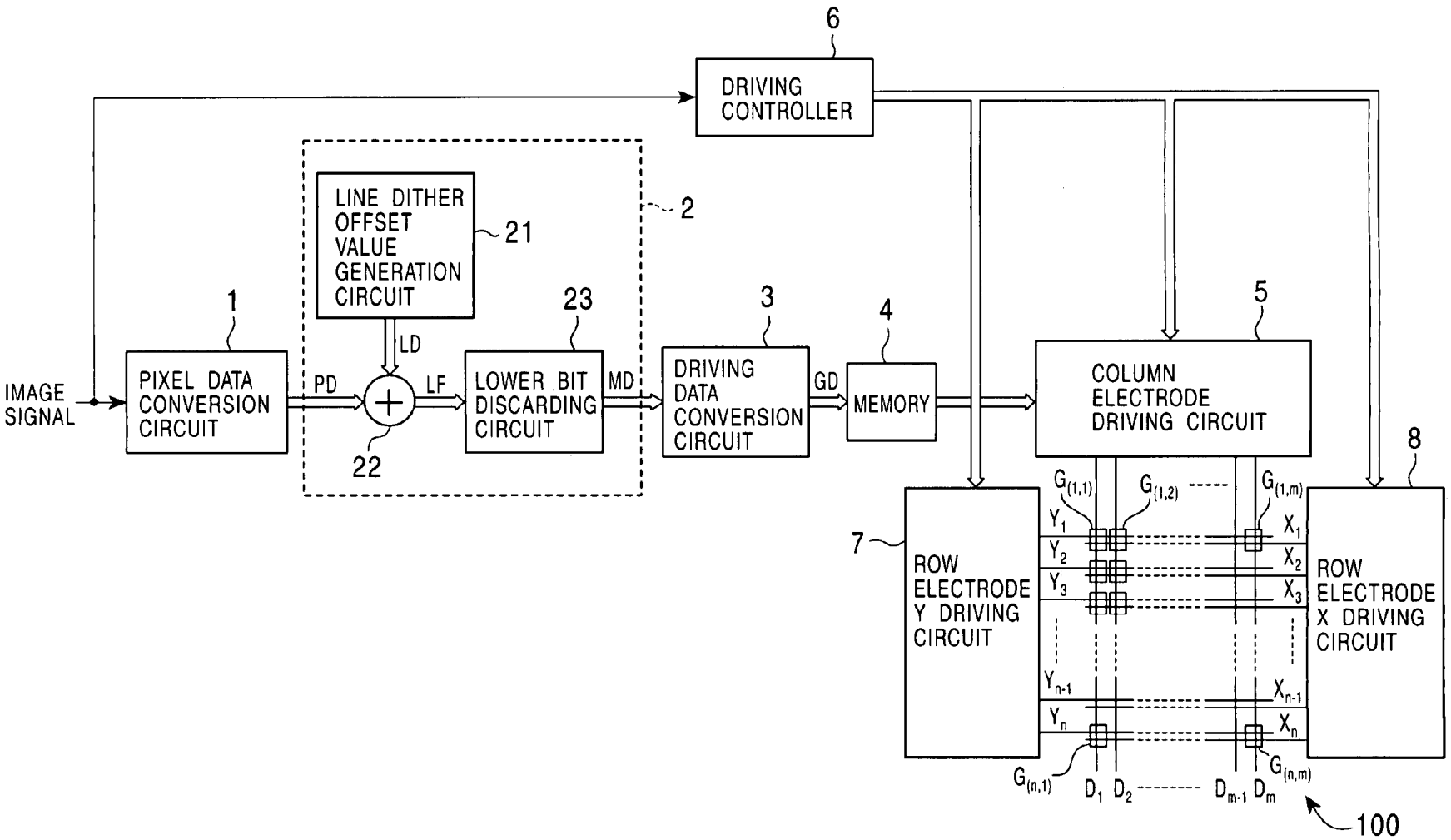
FIG. 3 shows the configuration of a plasma display device provided with a driving device of this invention.

Referring to FIG. 3, the configuration of a plasma display device provided with a driving device according to one embodiment of this invention will be described.

In FIG. 3, a plasma display panel or PDP 100 includes a front substrate (not shown) serving as the display surface, and a back substrate (not shown) positioned behind the front substrate, with a discharge space between the front and back substrates. The discharge space is charged with discharge gas. Strip-shaped row electrodes $X_1$ to $X_n$ and row electrodes $Y_1$ to $Y_n$, parallel to each other and positioned in alternation, are provided on the front substrate. Strip-shaped column electrodes $D_1$ to $D_m$ are positioned on the back substrate so as to intersect with the row electrodes $X_1$ to $X_n$ and $Y_1$ to $Y_n$. The PDP 100 has n display lines. Each pair of row electrodes $X_i$ and $Y_i$ constitutes one display line. Discharge cells G serving as pixels are formed at the intersecting portions (including the discharge space) of the row electrode pairs and column electrodes. That is, the PDP 100 has n×m discharge cells, $G_{(1,1)}$ to $G_{(n,m)}$, arranged in a matrix.

A pixel data conversion circuit 1 converts an input image signal into for example 6 bits of pixel data PD for each pixel, and supplies the pixel data PD to a multi-grayscale processing circuit 2. The multi-grayscale processing circuit 2 includes a line dither offset value generation circuit 21, adder 22, and lower-bit discard circuit 23.

The line dither offset value generation circuit 21 first divides the first through nth display lines of the PDP 100 into eight groups, in which display lines separated from each other by eight lines, as follows:

An (8N-7) display line group, consisting of the 1st, 9th, 17th, . . . , (n−7)th display lines;

an (8N-6) display line group, consisting of the 2nd, 10th, 18th, . . . , (n−6)th display lines;

an (8N-5) display line group, consisting of the 3rd, 11th, 19th, . . . , (n−5)th display lines;

an (8N-4) display line group, consisting of the 4th, 12th, 20th, . . . , (n−4)th display lines;

an (8N-3) display line group, consisting of the 5th, 13th, 21th, . . . , (n−3)th display lines;

an (8N-2) display line group, consisting of the 6th, 14th, 22th, . . . , (n−2)th display lines;

an (8N-1) display line group, consisting of the 7th, 15th, 23th, . . . , (n−1)th display lines; and, an (8N) display line group, consisting of the 8th, 16th, 24th, . . . , nth display lines.

(where N is a natural number of (1/8)·n or less)

The line dither offset value generation circuit 21 then creates eight line dither offset values LD with values from 0 to 7 for the above mentioned eight groups of display lines respectively. The line dither offset value generation circuit 21 repeatedly executes changes in the allocation to each display line group of the line dither offset values LD, for each field and taking eight fields as one cycle, as shown in FIG. 4A through FIG. 4H.

Figures 4A, 4B, 4C, 4D, 4E, 4F, 4G, 4H:
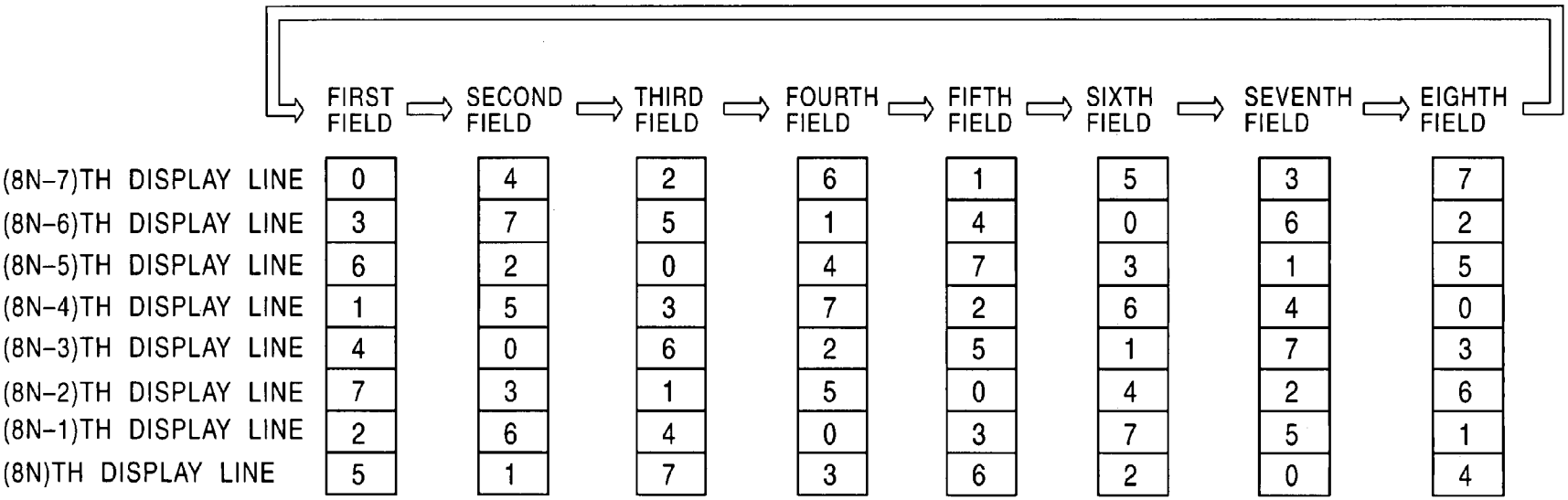
FIG. 4A through FIG. 4H show examples of line dither offset values.

In other words, in the first field, as shown in FIG. 4A, the line dither offset value generation circuit 21 allocates line dither offset values LD having the values:

"0" to the (8N-7) display line group;
"3" to the (8N-6) display line group;
"6" to the (8N-5) display line group;
"1" to the (8N-4) display line group;
"4" to the (8N-3) display line group;
"7" to the (8N-2) display line group;
"2" to the (8N-1) display line group; and,
"5" to the (8N) display line group.

In the next or second field, as shown in FIG. 4B, line dither offset values LD are allocated having the values:

"4" to the (8N-7) display line group;
"7" to the (8N-6) display line group;
"2" to the (8N-5) display line group;

"5" to the (8N-4) display line group;
"0" to the (8N-3) display line group;
"3" to the (8N-2) display line group;
"6" to the (8N-1) display line group; and,
"1" to the (8N) display line group.

In the third field, as shown in FIG. 4C, line dither offset values LD are allocated having the values:
"2" to the (8N-7) display line group;
"5" to the (8N-6) display line group;
"0" to the (8N-5) display line group;
"3" to the (8N-4) display line group;
"6" to the (8N-3) display line group;
"1" to the (8N-2) display line group;
"4" to the (8N-1) display line group; and,
"7" to the (8N) display line group.

In the fourth field, as shown in FIG. 4D, line dither offset values LD are allocated having the values:
"6" to the (8N-7) display line group;
"1" to the (8N-6) display line group;
"4" to the (8N-5) display line group;
"7" to the (8N-4) display line group;
"2" to the (8N-3) display line group;
"5" to the (8N-2) display line group;
"0" to the (8N-1) display line group; and,
"3" to the (8N) display line group.

In the fifth field, as shown in FIG. 4E, line dither offset values LD are allocated having the values:
"1" to the (8N-7) display line group;
"4" to the (8N-6) display line group;
"7" to the (8N-5) display line group;
"2" to the (8N-4) display line group;
"5" to the (8N-3) display line group;
"0" to the (8N-2) display line group;
"3" to the (8N-1) display line group; and,
"6" to the (8N) display line group.

In the sixth field, as shown in FIG. 4F, line dither offset values LD are allocated having the values:
"5" to the (8N-7) display line group;
"0" to the (8N-6) display line group;
"3" to the (8N-5) display line group;
"6" to the (8N-4) display line group;
"1" to the (8N-3) display line group;
"4" to the (8N-2) display line group;
"7" to the (8N-1) display line group; and,
"2" to the (8N) display line group.

In the seventh field, as shown in FIG. 4G, line dither offset values LD are allocated having the values:
"3" to the (8N-7) display line group;
"6" to the (8N-6) display line group;
"1" to the (8N-5) display line group;
"4" to the (8N-4) display line group;
"7" to the (8N-3) display line group;
"2" to the (8N-2) display line group;
"5" to the (8N-1) display line group; and,
"0" to the (8N) display line group.

And, in the eighth field, as shown in FIG. 4H, line dither offset values LD are allocated having the values:
"7" to the (8N-7) display line group;
"2" to the (8N-6) display line group;
"5" to the (8N-5) display line group;
"0" to the (8N-4) display line group;
"3" to the (8N-3) display line group;
"6" to the (8N-2) display line group;
"1" to the (8N-1) display line group; and,
"4" to the (8N) display line group.

The line dither offset value generation circuit 21 then supplies to the adder 22 the line dither offset values LD allocated to the display lines that have the discharge cells corresponding to the pixel data PD supplied by the pixel data conversion circuit 1.

The adder 22 adds the line dither offset values LD to the pixel data PD and supplies the resulting value, i.e., a line offset-added pixel data LF, to the lower-bit discard circuit 23. The lower-bit discard circuit 23 discards the lowest three bits of the line offset-added pixel data LF, and supplies the remaining upper three bits, as multi-grayscale pixel data MD, to a driving data conversion circuit 3.

The driving data conversion circuit 3 converts the multi-grayscale pixel data MD into the 4-bit pixel driving data GD according to a data conversion table shown in FIG. 5, and supplies the pixel driving data GD to a memory 4.

The memory 4 successively receives and stores the 4-bit pixel driving data GD. Each time writing of one image frame (n rows×m columns) of pixel driving data $GD_{1,1}$ to $GD_{n,m}$ ends, the memory 4 separates each of the pixel driving data $GD_{1,1}$ to $GD_{n,m}$ by bit digit (0th through 3rd bits), and reads out the results, one display line at a time, associated with the subfields SF0 to SF3. Then, the memory 4 supplies one display line's worth (m in number) of pixel driving data bits, as the pixel driving data bits DB1 to DB(m), to a column electrode driving circuit 5.

That is, first, in the subfield SF0, the memory 4 reads only the 0th bit of each of the pixel driving data items $GD_{1,1}$ to $GD_{n,m}$ one display line at a time, and supplies these bits, as the pixel driving data bits DB1 to DBm, to the column electrode driving circuit 5. In the subfield SF1, the memory 4 reads only the 1st bit of each of the pixel driving data items $GD_{1,1}$ to $GD_{n,m}$ one display line at a time, and supplies these bits, as the pixel driving data bits DB1 to DBm, to the column electrode driving circuit 5. In the subfield SF2, the memory 4 reads only the 2nd bit of each of the pixel driving data items $GD_{1,1}$ to $GD_{n,m}$ one display line at a time, and supplies these bits, as the pixel driving data bits DB1 to DBm, to the column electrode driving circuit 5. In the subfield SF3, the memory 4 reads only the 3rd bit of each of the pixel driving data items $GD_{1,1}$ to $GD_{n,m}$ one display line at a time, and supplies these bits, as the pixel driving data bits DB1 to DBm, to the column electrode driving circuit 5.

A driving control circuit 6 generates various timing signals for grayscale driving of the PDP 100 according to the light emission driving sequences shown in the following drawings for the respective subfields:

for the first field, the driving sequence in FIG. 6A,
for the second field, the driving sequence in FIG. 6B,
for the third field, the driving sequence in FIG. 6C,
for the fourth field, the driving sequence in FIG. 6D,
for the fifth field, the driving sequence in FIG. 6E,
for the sixth field, the driving sequence in FIG. 6F,
for the seventh field, the driving sequence in FIG. 6G, and
for the eighth field, the driving sequence in FIG. 6H.

The driving control circuit 6 then supplies these timing signals to the column electrode driving circuit 5, row electrode Y driving circuit 7, and row electrode X driving circuit 8. It should be noted that the series of driving shown in FIG. 6A through FIG. 6H is executed repeatedly.

The column electrode driving circuit 5, row electrode Y driving circuit 7, and row electrode X driving circuit 8 generate driving pulses (not shown) so as to drive the PDP 100 as described below according to the timing signals supplied by the driving control circuit 6, and applies these driving pulses to the column electrodes $D_1$ to $D_m$, row electrodes $X_1$ to $X_n$, and row electrodes $Y_1$ to $Y_n$ of the PDP 100.

In the light emission driving sequences shown in FIG. 6A through FIG. 6H, each of the fields in the input image signal is divided into five subfields SF0 to SF4.

First, in the leading subfield SF0, a reset process R and an addressing process W0 are executed in sequence. In the reset process R, all the discharge cells $G_{(1,1)}$ to $G_{(n,m)}$ of the PDP 100 are caused to undergo a reset discharge simultaneously, to initialize each of the discharge cells $G_{(1,1)}$ to $G_{(n,m)}$ in the lit mode (a state in which a prescribed amount of wall charge is formed). In the addressing process W0, the discharge cells G positioned in each of the first through nth display lines of the PDP 100 are caused to undergo selective erase discharge, one display line at a time, according to the pixel driving data GD shown in FIG. 5, so that these discharge cells (selected discharge cells) become the extinguished mode (unlit mode; a state in which the wall charge is erased). In this addressing process W0, discharge cells in which the erase discharge has not occurred remain in the immediately preceding state, that is, the lit mode is maintained.

Next, each of the subfields SF1 to SF3 is further divided into eight subfields, namely, $SF1_1$ to $SF1_8$, $SF2_1$ to $SF2_8$, and $SF3_1$ to $SF3_8$. In each of the subfields $SF1_1$ to $SF1_8$, $SF2_1$ to $SF2_8$, and $SF3_1$ to $SF3_8$, the following addressing processes W1 to W8 are executed.

In the addressing process W1, only the discharge cells positioned in the (8N-7)th display lines, namely, the first, 9th, 17th, . . . , (n−7)th display lines among all the discharge cells $G_{(1,1)}$ to $G_{(n,m)}$ formed in the PDP 100, are selectively caused to undergo erase discharge according to the pixel driving data. As a result, the discharge cells in which the erase discharge has occurred are set to the extinguished mode, and the discharge cells in which the erase discharge has not occurred maintain the immediately preceding state. In the addressing process W1, therefore, the discharge cells positioned in the (8N-7)th display lines are set to either the extinguished mode or to the lit mode, according to the pixel driving data.

In the addressing process W2, only the discharge cells positioned in the (8N-6)th display lines, namely, the second, 10th, 18th, . . . , (n−6)th display lines, are selectively caused to undergo the erase discharge according to the pixel driving data. As a result, the discharge cells in which the erase discharge has occurred are set to the extinguished mode, and the discharge cells in which the erase discharge has not occurred maintain the immediately preceding state. In the addressing process W2, therefore, the discharge cells positioned in the (8N-6)th display lines are set to either the extinguished mode or to the lit mode, according to the pixel driving data.

In the addressing process W3, only the discharge cells positioned in the (8N-5)th display lines, namely, the third, 11th, 19th, . . . , (n−5)th display lines, are selectively caused to undergo the erase discharge according to the pixel driving data. As a result, the discharge cells in which the erase discharge has occurred are set to the extinguished mode, and the discharge cells in which the erase discharge has not occurred maintain the immediately preceding state. That is, through the addressing process W3, the discharge cells positioned in the (8N-5)th display lines are set to either the extinguished mode or to the lit mode, according to the pixel driving data.

In the addressing process W4, only the discharge cells positioned in the (8N-4)th display lines, namely, the 4th, 12th, 20th, . . . , (n−4)th display lines, are selectively caused to undergo the erase discharge according to the pixel driving data. As a result, the discharge cells in which the erase discharge has occurred are set to the extinguished mode, and the discharge cells in which the erase discharge has not occurred maintain the immediately preceding state. That is, through the addressing process W4, the discharge cells positioned in the (8N-4)th display lines are set to either the extinguished mode or to the lit mode, according to the pixel driving data.

In the addressing process W5, only the discharge cells positioned in the (8N-3)th display lines, namely, the 5th, 13th, 21th, . . . , (n−3)th display lines, are selectively caused to undergo the erase discharge according to the pixel driving data. As a result, the discharge cells in which the erase discharge has occurred are set to the extinguished mode, and the discharge cells in which the erase discharge has not occurred maintain the immediately preceding state. In the addressing process W5, therefore, the discharge cells positioned in the (8N-3)th display lines are set to either the extinguished mode or to the lit mode, according to the pixel driving data.

In the addressing process W6, only the discharge cells positioned in the (8N-2)th display lines, namely, the 6th, 14th, 22th, . . . , (n−2)th display lines, are selectively caused to undergo erase discharge according to the pixel driving data. As a result, the discharge cells in which the erase discharge has occurred are set to the extinguished mode, and the discharge cells in which the erase discharge has not occurred maintain the immediately preceding state. In the addressing process W6, therefore, the discharge cells positioned in the (8N-2)th display lines are set to either the extinguished mode or to the lit mode, according to the pixel driving data.

In the addressing process W7, only the discharge cells positioned in the (8N-1)th display lines, namely, the 7th, 15th, 23th, . . . , (n−1)th display lines, are selectively caused to undergo the erase discharge according to the pixel driving data. As a result, the discharge cells in which the erase discharge has occurred are set to the extinguished mode, and the discharge cells in which the erase discharge has not occurred maintain the immediately preceding state. That is, through the addressing process W7, the discharge cells positioned in the (8N-1)th display lines are set to either the extinguished mode or to the lit mode, according to the pixel driving data.

In the addressing process W8, only the discharge cells positioned in the (8N)th display lines, namely, the 8th, 16th, 24th, . . . , nth display lines, are selectively caused to undergo the erase discharge according to the pixel driving data. As a result, the discharge cells in which the erase discharge has occurred are set to the extinguished mode, and the discharge cells in which the erase discharge has not occurred maintain the immediately preceding state. That is, through the addressing process W8, the discharge cells positioned in the (8N)th display lines are set to either the extinguished mode or to the lit mode, according to the pixel driving data.

In the light emission driving sequence shown in FIG. 6A, the following addressing processes are executed:

the addressing process W6 is executed in each of the subfields $SF1_1$, $SF2_1$ and $SF3_1$;

the addressing process W3 is executed in each of the subfields $SF1_2$, $SF2_2$ and $SF3_2$;

the addressing process W8 is executed in each of the subfields $SF1_3$, $SF2_3$ and $SF3_3$;

the addressing process W5 is executed in each of the subfields $SF1_4$, $SF2_4$ and $SF3_4$;

the addressing process W2 is executed in each of the subfields $SF1_5$, $SF2_5$ and $SF3_5$;

the addressing process W7 is executed in each of the subfields $SF1_6$, $SF2_6$ and $SF3_6$;

the addressing process W4 is executed in each of the subfields $SF1_7$, $SF2_7$ and $SF3_7$; and, the addressing process W1 is executed in each of the subfields $SF1_8$, $SF2_8$ and $SF3_8$.

In the light emission driving sequence shown in FIG. 6B, the following addressing processes are executed:

the addressing process W2 is executed in each of the subfields $SF1_1$, $SF2_1$ and $SF3_1$;

the addressing process W7 is executed in each of the subfields $SF1_2$, $SF2_2$ and $SF3_2$;

the addressing process W4 is executed in each of the subfields $SF1_3$, $SF2_3$ and $SF3_3$;

the addressing process W1 is executed in each of the subfields $SF1_4$, $SF2_4$ and $SF3_4$;

the addressing process W6 is executed in each of the subfields $SF1_5$, $SF2_5$ and $SF3_5$;

the addressing process W3 is executed in each of the subfields $SF1_6$, $SF2_6$ and $SF3_6$;

the addressing process W8 is executed in each of the subfields $SF1_7$, $SF2_7$ and $SF3_7$; and, the addressing process W5 is executed in each of the subfields $SF1_8$, $SF2_8$ and $SF3_8$.

In the light emission driving sequence shown in FIG. 6C, the following addressing processes are executed:

the addressing process W8 is executed in each of the subfields $SF1_1$, $SF2_1$ and $SF3_1$;

the addressing process W5 is executed in each of the subfields $SF1_2$, $SF2_2$ and $SF3_2$;

the addressing process W2 is executed in each of the subfields $SF1_3$, $SF2_3$ and $SF3_3$;

the addressing process W7 is executed in each of the subfields $SF1_4$, $SF2_4$ and $SF3_4$;

the addressing process W4 is executed in each of the subfields $SF1_5$, $SF2_5$ and $SF3_5$;

the addressing process W1 is executed in each of the subfields $SF1_6$, $SF2_6$ and $SF3_6$;

the addressing process W6 is executed in each of the subfields $SF1_7$, $SF2_7$ and $SF3_7$; and, the addressing process W3 is executed in each of the subfields $SF1_8$, $SF2_8$ and $SF3_8$.

In the light emission driving sequence shown in FIG. 6D, the following addressing processes are executed:

the addressing process W4 is executed in each of the subfields $SF1_1$, $SF2_1$ and $SF3_1$;

the addressing process W1 is executed in each of the subfields $SF1_2$, $SF2_2$ and $SF3_2$;

the addressing process W6 is executed in each of the subfields $SF1_3$, $SF2_3$ and $SF3_3$;

the addressing process W3 is executed in each of the subfields $SF1_4$, $SF2_4$ and $SF3_4$;

the addressing process W8 is executed in each of the subfields $SF1_5$, $SF2_5$ and $SF3_5$;

the addressing process W5 is executed in each of the subfields $SF1_{61}$ $SF2_6$ and $SF3_6$;

the addressing process W2 is executed in each of the subfields $SF1_7$, $SF2_7$ and $SF3_7$; and, the addressing process W7 is executed in each of the subfields $SF1_8$, $SF2_8$ and $SF3_8$.

In the light emission driving sequence shown in FIG. 6E, the following addressing processes are executed:

the addressing process W3 is executed in each of the subfields $SF1_1$, $SF2_1$ and $SF3_1$;

the addressing process W8 is executed in each of the subfields $SF1_2$, $SF2_2$ and $SF3_2$;

the addressing process W5 is executed in each of the subfields $SF1_3$, $SF2_3$ and $SF3_3$;

the addressing process W2 is executed in each of the subfields $SF1_4$, $SF2_4$ and $SF3_4$;

the addressing process W7 is executed in each of the subfields $SF1_5$, $SF2_5$ and $SF3_5$;

the addressing process W4 is executed in each of the subfields $SF1_6$, $SF2_6$ and $SF3_6$;

the addressing process W1 is executed in each of the subfields $SF1_7$, $SF2_7$ and $SF3_7$; and, the addressing process W6 is executed in each of the subfields $SF1_8$, $SF2_8$ and $SF3_8$.

In the light emission driving sequence shown in FIG. 6F, the following addressing processes are executed:

the addressing process W7 is executed in each of the subfields $SF1_1$, $SF2_1$ and $SF3_1$;

the addressing process W4 is executed in each of the subfields $SF1_2$, $SF2_2$ and SF32;

the addressing process W1 is executed in each of the subfields $SF1_3$, $SF2_3$ and $SF3_3$;

the addressing process W6 is executed in each of the subfields $SF1_4$, $SF2_4$ and $SF3_4$;

the addressing process W3 is executed in each of the subfields $SF1_5$, $SF2_5$ and SF35;

the addressing process W8 is executed in each of the subfields $SF1_6$, $SF2_6$ and $SF3_6$;

the addressing process W5 is executed in each of the subfields $SF1_7$, $SF2_7$ and $SF3_7$; and, the addressing process W2 is executed in each of the subfields $SF1_8$, $SF2_8$ and $SF3_8$.

In the light emission driving sequence shown in FIG. 6G, the following addressing processes are executed:

the addressing process W5 is executed in each of the subfields $SF1_1$, $SF2_1$ and $SF3_1$;

the addressing process W2 is executed in each of the subfields $SF1_2$, $SF2_2$ and $SF3_2$;

the addressing process W7 is executed in each of the subfields $SF1_3$, $SF2_3$ and $SF3_3$;

the addressing process W4 is executed in each of the subfields $SF1_4$, $SF2_4$ and $SF3_4$;

the addressing process W1 is executed in each of the subfields $SF1_5$, $SF2_5$ and $SF3_5$;

the addressing process W6 is executed in each of the subfields $SF1_6$, $SF2_6$ and $SF3_6$;

the addressing process W3 is executed in each of the subfields $SF1_7$, $SF2_7$ and $SF3_7$; and, the addressing process W8 is executed in each of the subfields $SF1_8$, $SF2_8$ and $SF3_8$.

In the light emission driving sequence shown in FIG. 6H, the following addressing processes are executed:

the addressing process W1 is executed in each of the subfields $SF1_1$, $SF2_1$ and $SF3_1$;

the addressing process W6 is executed in each of the subfields $SF1_2$, $SF2_2$ and $SF3_2$;

the addressing process W3 is executed in each of the subfields $SF1_3$, $SF2_3$ and $SF3_3$;

the addressing process W8 is executed in each of the subfields $SF1_4$, $SF2_4$ and $SF3_4$;

the addressing process W5 is executed in each of the subfields $SF1_5$, $SF2_5$ and $SF3_5$;

the addressing process W2 is executed in each of the subfields $SF1_6$, $SF2_6$ and $SF3_6$;

the addressing process W7 is executed in each of the subfields $SF1_7$, $SF2_7$ and $SF3_7$; and, the addressing process W4 is executed in each of the subfields $SF1_8$, $SF2_8$ and $SF3_8$.

In each of the subfields $S1_1$ to $SF1_8$, $SF2_1$ to $SF2_8$, and $SF3_1$ to $SF3_8$, immediately before the associated addressing process (one of the addressing processes W1 to W8), a sustain process I is executed to cause discharge light emission continuously over the period "1" in only the discharge cells set to the lit mode.

In the final subfield SF4, only the sustain process I to cause discharge light emission is executed continuously over the period "1" in only the discharge cells set to the lit mode.

The driving control circuit 6 performs the light emission driving shown in FIG. 7 through FIG. 14, according to the light emission driving sequences shown in FIG. 6A through FIG. 6H.

FIG. 7 shows the light emission driving pattern based on the light emission driving sequence of FIG. 6A, FIG. 8 shows the light emission driving pattern based on the light emission driving sequence of FIG. 6B, FIG. 9 shows the light emission driving pattern based on the light emission driving sequence of FIG. 6C, FIG. 10 shows the light emission driving pattern based on the light emission driving sequence of FIG. 6D, FIG. 11 shows the light emission driving pattern based on the light emission driving sequence of FIG. 6E, FIG. 12 shows the light emission driving pattern based on the light emission driving sequence of FIG. 6F, FIG. 13 shows the light emission driving pattern based on the light emission driving sequence of FIG. 6G, and FIG. 14 shows the light emission driving pattern based on the light emission driving sequence of FIG. 6H.

When the pixel driving data GD "1000", representing the lowest brightness, is supplied, light emission is induced based on first grayscale driving, as will be described below. The 0th bit of the pixel driving data GD is logical level 1, so that in the addressing process W0 of the subfield SF0 the erase discharge (indicated by a black circle) is caused in the discharge cell, and this discharge cell makes a transition to the extinguished mode. In the driving operations shown in FIG. 6A through FIG. 6H, a transition of a discharge cell during one field display period from the extinguished mode to the lit mode is possible only during the reset process R of the leading subfield SF0. Hence a discharge cell which has once made a transition to the extinguished mode is maintained in the extinguished mode throughout the field display period.

Figure 15:
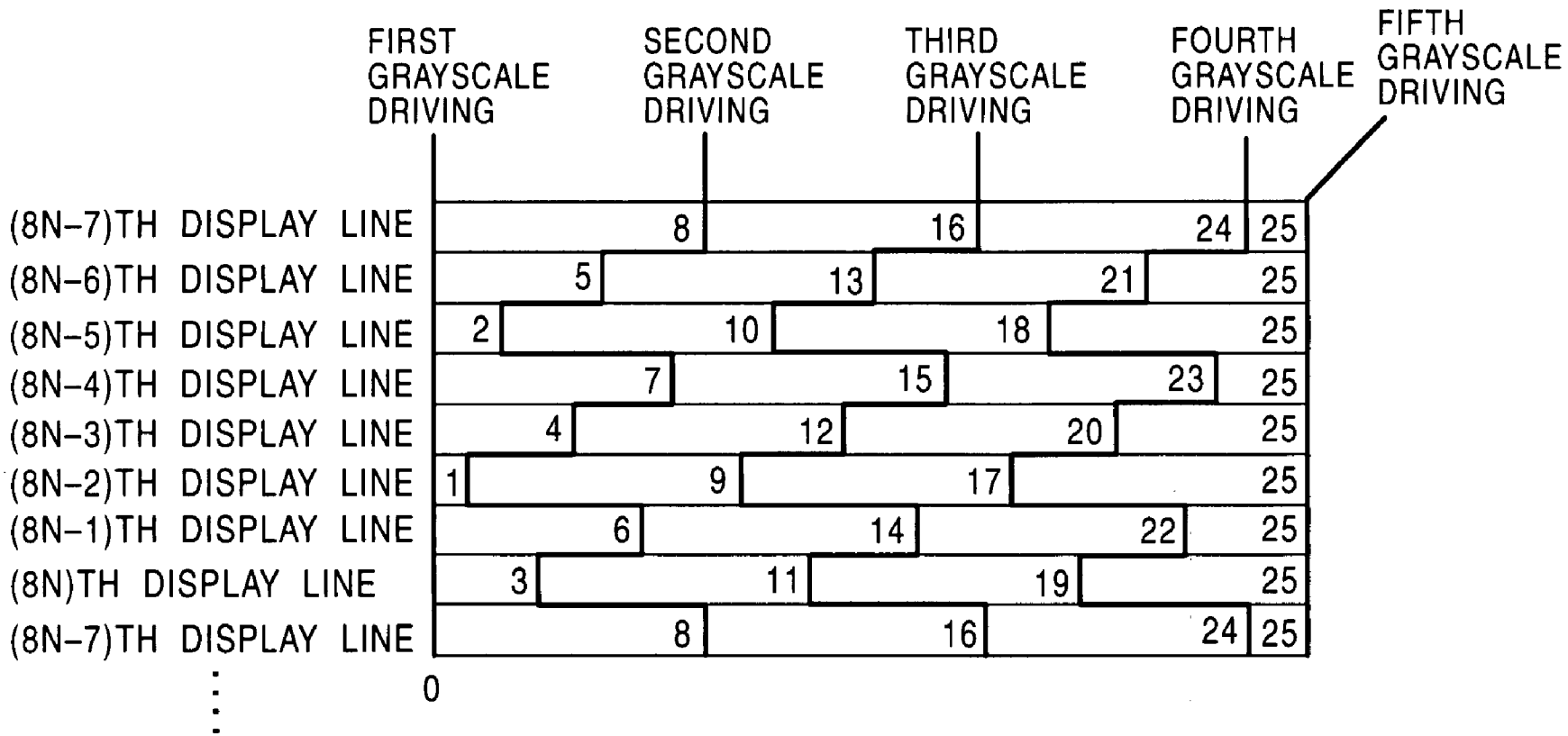
FIG. 15 shows the brightness levels for first through fifth gray scale driving for each display line.

In other words, as a result of the first grayscale driving according to the "1000" pixel driving data GD, each discharge cell is maintained in the extinguished state throughout the field display period, and driving at the brightness level 0 is performed, as shown in FIG. 15.

When "0100" pixel driving data GD is supplied, representing a level brighter by one level than the "1000" pixel driving data, light emission is performed based on second grayscale driving, as described below. That is, because the 1st bit of the pixel driving data GD is logical level 1, erase discharge (indicated by a double circle) is caused in the discharge cell during the addressing process W1 to W8 of the subfield SF1. Here, after a discharge cell is initialized to the lit mode by the reset process R in the leading subfield SF0, continuous sustain discharge light emission is effected in sustain processes I existing during the interval until occurrence of the erase discharge. For example, in the light emission driving sequence shown in FIG. 6A, the address processes are performed in the following manner:

the addressing process W6 to cause erase discharge in the (8N-7) display line group takes place during the subfield $SF1_1$;

the addressing process W3 to cause erase discharge in the (8N-6) display line group takes place during the subfield $SF1_2$;

the addressing process W8 to cause erase discharge in the (8N-5) display line group takes place during the subfield $SF1_3$;

the addressing process W5 to cause erase discharge in the (8N-4) display line group takes place during the subfield $SF1_4$;

the addressing process W2 to cause erase discharge in the (8N-3) display line group takes place during the subfield $SF1_5$;

the addressing process W7 to cause erase discharge in the (8N-2) display line group takes place during the subfield $SF1_6$;

the addressing process W4 to cause erase discharge in the (8N-1) display line group takes place during the subfield $SF1_7$; and, the addressing process W1 to cause erase discharge in the (8N) display line group takes place during the subfield $SF1_8$.

Hence as indicated by the white circles and double circles in FIG. 7, continuous sustain discharge occurs in discharge cells during the sustain processes I as follows:

during the sustain processes I of the subfields $SF1_1$ to $SF1_8$, the continuous sustain discharge occurs for the (8N-7)th display lines;

during the sustain processes I of the subfields $SF1_1$ to $SF1_5$ the continuous sustain discharge occurs for the (8N-6)th display lines;

during the sustain processes I of the subfields $SF1_1$ to $SF1_2$ the continuous sustain discharge occurs for the (8N-5)th display lines;

during the sustain processes I of the subfields $SF1_1$ to $SF1_7$ the continuous sustain discharge occurs for the (8N-4)th display lines;

during the sustain processes I of the subfields $SF1_1$ to $SF1_4$ the continuous sustain discharge occurs for the (8N-3)th display lines;

during the sustain process I of the subfield $SF1_1$ the continuous sustain discharge occurs for the (8N-2)th display lines;

during the sustain processes I of the subfields $SF1_1$ to $SF1_6$ the continuous sustain discharge occurs for the (8N-1)th display lines; and, during the sustain processes I of the subfields $SF1_1$ to $SF1_3$ the continuous sustain discharge occurs for the (8N)th display lines.

In other words, as a result of the second grayscale driving according to the "0100" pixel driving data GD, driving of the discharge cells in the display lines is performed at brightness levels corresponding to the period of light emission generated by the sustain discharge occurring in one field display period; that is, as shown in FIG. 15, driving is performed in the following manner:

at brightness level "8" for discharge cells positioned in (8N-7)th display lines;

at brightness level "5" for discharge cells positioned in (8N-6)th display lines;

at brightness level "2" for discharge cells positioned in (8N-5)th display lines;

at brightness level "7" for discharge cells positioned in (8N-4)th display lines;

at brightness level "4" for discharge cells positioned in (8N-3)th display lines;

at brightness level "1" for discharge cells positioned in (8N-2)th display lines;

at brightness level "6" for discharge cells positioned in (8N-1)th display lines; and, at brightness level "3" for discharge cells positioned in (8N)th display lines.

When "0010" pixel driving data GD is supplied, representing a level brighter by one level than the "0100" pixel driving data, light emission is induced based on third grayscale driving, as described below. That is, because the 2nd bit of the pixel driving data GD is logical level 1, in the addressing processes W1 to W8 of the subfield SF2 erase discharge (indicated by a double circle) is caused in the discharge cell. Here, after a discharge cell is initialized to the lit mode by the reset process R in the leading subfield SF0, continuous sustain discharge light emission is effected in sustain processes I existing during the interval until occurrence of the erase discharge. For example, in the light emission driving sequence shown in FIG. 6A, the address processes are performed in the following manner:

the addressing process W6 to cause erase discharge in the (8N-7) display line group occurs during the subfield $SF2_1$;

the addressing process W3 to cause erase discharge in the (8N-6) display line group occurs during the subfield $SF2_2$;

the addressing process W8 to cause erase discharge in the (8N-5) display line group occurs during the subfield $SF2_3$;

the addressing process W5 to cause erase discharge in the (8N-4) display line group occurs during the subfield $SF2_4$;

the addressing process W2 to cause erase discharge in the (8N-3) display line group occurs during the subfield $SF2_5$;

the addressing process W7 to cause erase discharge in the (8N-2) display line group occurs during the subfield $SF2_6$;

the addressing process W4 to cause erase discharge in the (8N-1) display line group occurs during the subfield $SF2_7$; and, the addressing process W1 to cause erase discharge in the (8N) display line group occurs during the subfield $SF2_8$.

Hence as indicated by the white circles and double circles in FIG. 7, continuous sustain discharge occurs in discharge cells over sustain processes I as follows:

during the sustain processes I of the subfields $SF1_1$ to $SF1_8$ and $SF2_1$ to $SF2_8$, the continuous sustain discharge takes place for the (8N-7)th display lines;

during the sustain processes I of the subfields $SF1_1$ to $SF1_8$ and $SF2_1$ to $SF2_5$ the continuous sustain discharge takes place for the (8N-6)th display lines;

during the sustain processes I of the sustain processes I of the subfields $SF1_1$ to $SF1_8$ and $SF2_1$ to $SF2_2$ the continuous sustain discharge takes place for the (8N-5)th display lines;

during the sustain processes I of the subfields $SF1_1$ to $SF1_8$ and $SF2_1$ to $SF2_7$ the continuous sustain discharge takes place for the (8N-4)th display lines;

during the sustain processes I of the subfields $SF1_1$ to $SF1_8$ and $SF2_1$ to $SF2_4$ the continuous sustain discharge takes place for the (8N-3)th display lines;

during the sustain processes I of the subfields $SF1_1$ to $SF1_8$ and $SF2_1$ the continuous sustain discharge takes place for the (8N-2)th display lines;

during the sustain processes I of the subfields $SF1_1$ to $SF1_8$ and $SF2_1$ to $SF2_6$ the continuous sustain discharge takes place for the (8N-1)th display lines; and, during the sustain processes I of the subfields $SF1_1$ to $SF1_8$ and $SF2_1$ to $SF2_3$ the continuous sustain discharge takes place for the (8N)th display lines.

In other words, as a result of the third grayscale driving according to the "0010" pixel driving data GD, driving of the discharge cells in the display lines is performed at brightness levels corresponding to the period of light emission generated by the sustain discharge occurring in one field display period; that is, as shown in FIG. 15, driving is performed:

at brightness level "16" for discharge cells positioned in the (8N-7)th display lines;

at brightness level "13" for discharge cells positioned in the (8N-6)th display lines;

at brightness level "10" for discharge cells positioned in the (8N-5)th display lines;

at brightness level "15" for discharge cells positioned in the (8N-4)th display lines;

at brightness level "12" for discharge cells positioned in the (8N-3)th display lines;

at brightness level "9" for discharge cells positioned in the (8N-2)th display lines;

at brightness level "14" for discharge cells positioned in the (8N-1)th display lines; and, at brightness level "11" for discharge cells positioned in the (8N)th display lines.

When "0001" pixel driving data GD is supplied, representing a level brighter by one level than the "0010" pixel driving data, light emission is induced based on fourth grayscale driving. That is, because the 3rd bit of the pixel driving data GD is logical level 1, in the addressing processes W1 to W8 of the subfield SF3 erase discharge (indicated by a double circle) is caused in the discharge cell. Here, after a discharge cell is initialized to the lit mode by the reset process R in the leading subfield SF0, continuous sustain discharge light emission is effected in successive sustain processes I existing during the interval until occurrence of the erase discharge. For example, in the light emission driving sequence shown in FIG. 6A, the address processes are performed in the following manner:

the addressing process W6 to cause erase discharge in the (8N-7) display line group takes place during the subfield $SF3_1$;

the addressing process W3 to cause erase discharge in the (8N-6) display line group takes place during the subfield $SF3_2$;

the addressing process W8 to cause erase discharge in the (8N-5) display line group takes place during the subfield $SF3_3$;

the addressing process W5 to cause erase discharge in the (8N-4) display line group takes place during the subfield $SF3_4$;

the addressing process W2 to cause erase discharge in the (8N-3) display line group takes place during the subfield $SF3_5$;

the addressing process W7 to cause erase discharge in the (8N-2) display line group takes place during the subfield $SF3_6$;

the addressing process W4 to cause erase discharge in the (8N-1) display line group takes place during the subfield $SF3_7$; and, the addressing process W1 to cause erase discharge in the (8N) display line group takes place during the subfield $SF3_8$.

Hence as indicated by the white circles and double circles in FIG. 7, continuous sustain discharge occurs in discharge cells during the sustain processes I as follows:

during the sustain processes I of the subfields $SF1_1$ to $SF2_8$ and $SF3_1$ to $SF3_8$, the continuous sustain discharge occurs for the (8N-7)th display lines;

during the sustain processes I of the subfields $SF1_1$ to $SF2_8$ and $SF3_1$ to $SF3_5$ the continuous sustain discharge occurs for the (8N-6)th display lines;

during the sustain processes I of the subfields $SF1_1$ to $SF2_8$ and $SF3_1$ to $SF3_2$ the continuous sustain discharge occurs for the (8N-5)th display lines;

during the sustain processes I of the subfields $SF1_1$ to $SF2_8$ and $SF3_1$ to $SF3_7$ the continuous sustain discharge occurs for the (8N-4)th display lines;

during the sustain processes I of the subfields $SF1_1$ to $SF2_8$ and $SF3_1$ to $SF3_4$ the continuous sustain discharge occurs for the (8N-3)th display lines;

during the sustain processes I of the subfields $SF1_1$ to $SF2_8$ and $SF3_1$ the continuous sustain discharge occurs for the (8N-2)th display lines;

during the sustain processes I of the subfields $SF1_1$ to $SF2_8$ and $SF3_1$ to $SF3_6$ the continuous sustain discharge occurs for the (8N-1)th display lines; and, during the sustain processes I of the subfields $SF1_1$ to $SF2_8$ and $SF3_1$ to $SF3_3$ the continuous sustain discharge occurs for the (8N)th display lines.

In other words, as a result of the fourth grayscale driving according to the "0001" pixel driving data GD, driving of the discharge cells in the display lines is performed at brightness levels corresponding to the period of light emission generated by the sustain discharge occurring in one field display period; that is, as shown in FIG. 15, the discharge cells are driven to emit light at the following brightness levels:

at brightness level "24" for the discharge cells positioned in the (8N-7)th display lines;

at brightness level "21" for the discharge cells positioned in the (8N-6)th display lines;

at brightness level "18" for the discharge cells positioned in the (8N-5)th display lines;

at brightness level "23" for the discharge cells positioned in the (8N-4)th display lines;

at brightness level "20" for the discharge cells positioned in the (8N-3)th display lines;

at brightness level "17" for the discharge cells positioned in the (8N-2)th display lines;

at brightness level "22" for the discharge cells positioned in the (8N-1)th display lines; and, at brightness level "19" for the discharge cells positioned in the (8N)th display lines.

When "0000" pixel driving data GD, representing the brightest level, is supplied, light emission is induced based on fifth grayscale driving. That is, because all the bits of the pixel driving data GD are at logical level 0, erase discharge is not caused at all throughout the field display period. Hence the discharge cell continuously undergoes discharge light emission in the sustain processes I in the subfields $SF1_1$ to $SF1_8$, $SF2_1$ to $SF2_8$, $SF3_1$ to $SF3_8$, and SF4.

In other words, as a result of the fifth grayscale driving according to the "0000" pixel driving data GD, each discharge cell emits light at the brightness level corresponding to the period of light emission generated by the sustain discharge occurring in one field display period; that is, as shown in FIG. 15, the discharge cells are driven to emit light at the following brightness level:

at brightness level "25" for discharge cells positioned in the (8N-7)th display lines;

at brightness level "25" for discharge cells positioned in the (8N-6)th display lines;

at brightness level "25" for discharge cells positioned in the (8N-5)th display lines;

at brightness level "25" for discharge cells positioned in the (8N-4)th display lines;

at brightness level "25" for discharge cells positioned in the (8N-3)th display lines;

at brightness level "25" for discharge cells positioned in the (8N-2)th display lines;

at brightness level "25" for discharge cells positioned in the (8N-1)th display lines; and, at brightness level "25" for discharge cells positioned in the (8N)th display lines.

Thus in the above described driving, first through fifth grayscale driving is performed enabling expression of brightnesses in five levels, according to the five pixel driving data GD values "1000", "0100", "0010", "0001", and "0000". Here, different brightness weightings are assigned to the eight neighboring display lines, and for each of the first through fifth grayscale driving levels, the neighboring eight display lines are driven at different brightnesses in accordance with the brightness weightings.

For example, in the driving operation according to the light emission driving sequence for the first field shown in FIG. 6A, brightness weightings are allocated to the eight neighboring display lines as follows:

(8N-7)th display lines: brightness weighting "8",
(8N-6)th display lines: brightness weighting "5",
(8N-5)th display lines: brightness weighting "2",
(8N-4)th display lines: brightness weighting "7",
(8N-3)th display lines: brightness weighting "4",
(8N-2)th display lines: brightness weighting "1",
(8N-1)th display lines: brightness weighting "6",
(8N)th display lines: brightness weighting "3".

In the driving operation according to the light emission driving sequence for the second field shown in FIG. 6B, brightness weightings are allocated to the eight neighboring display lines as follows:

(8N-7)th display lines: brightness weighting "4",
(8N-6)th display lines: brightness weighting "1",
(8N-5)th display lines: brightness weighting "6",
(8N-4)th display lines: brightness weighting "3",
(8N-3)th display lines: brightness weighting "8",
(8N-2)th display lines: brightness weighting "5",
(8N-1)th display lines: brightness weighting "2",
(8N)th display lines: brightness weighting "7".

In driving according to the light emission driving sequence for the third field shown in FIG. 6C, brightness weightings are allocated to the eight neighboring display lines as follows:

(8N-7)th display lines: brightness weighting "6",
(8N-6)th display lines: brightness weighting "3",
(8N-5)th display lines: brightness weighting "8",
(8N-4)th display lines: brightness weighting "5",
(8N-3)th display lines: brightness weighting "2",
(8N-2)th display lines: brightness weighting "7",
(8N-1)th display lines: brightness weighting "4",
(8N)th display lines: brightness weighting "1".

In the driving operation according to the light emission driving sequence for the fourth field shown in FIG. 6D, brightness weightings are allocated to the eight neighboring display lines as follows:

(8N-7)th display lines: brightness weighting "2",
(8N-6)th display lines: brightness weighting "7",
(8N-5)th display lines: brightness weighting "4",
(8N-4)th display lines: brightness weighting "1",
(8N-3)th display lines: brightness weighting "6",
(8N-2)th display lines: brightness weighting "3",
(8N-1)th display lines: brightness weighting "8",
(8N)th display lines: brightness weighting "5".

In the driving operation according to the light emission driving sequence for the fifth field shown in FIG. 6E, brightness weightings are allocated to the eight neighboring display lines as follows:

(8N-7)th display lines: brightness weighting "7",
(8N-6)th display lines: brightness weighting "4",
(8N-5)th display lines: brightness weighting "1",
(8N-4)th display lines: brightness weighting "6",
(8N-3)th display lines: brightness weighting "3",
(8N-2)th display lines: brightness weighting "8",
(8N-1)th display lines: brightness weighting "5",
(8N)th display lines: brightness weighting "2".

In the driving operation according to the light emission driving sequence for the sixth field shown in FIG. 6F, brightness weightings are allocated to the eight neighboring display lines as follows:

(8N-7)th display lines: brightness weighting "3",
(8N-6)th display lines: brightness weighting "8",
(8N-5)th display lines: brightness weighting "5",
(8N-4)th display lines: brightness weighting "2",
(8N-3)th display lines: brightness weighting "7",
(8N-2)th display lines: brightness weighting "4",
(8N-1)th display lines: brightness weighting "1",
(8N)th display lines: brightness weighting "6".

In the driving operation according to the light emission driving sequence for the seventh field shown in FIG. 6G, brightness weightings are allocated to the eight neighboring display lines as follows:

(8N-7)th display lines: brightness weighting "5",
(8N-6)th display lines: brightness weighting "2",
(8N-5)th display lines: brightness weighting "7",
(8N-4)th display lines: brightness weighting "4",
(8N-3)th display lines: brightness weighting "1",
(8N-2)th display lines: brightness weighting "6",
(8N-1)th display lines: brightness weighting "3",
(8N)th display lines: brightness weighting "8".

In the driving operation according to the light emission driving sequence for the eighth field shown in FIG. 6H, brightness weightings are allocated to the eight neighboring display lines as follows:

(8N-7)th display lines: brightness weighting "1",
(8N-6)th display lines: brightness weighting "6",
(8N-5)th display lines: brightness weighting "3",
(8N-4)th display lines: brightness weighting "8",
(8N-3)th display lines: brightness weighting "5",
(8N-2)th display lines: brightness weighting "2",
(8N-1)th display lines: brightness weighting "7",
(8N)th display lines: brightness weighting "4".

Hence different light emission is induced in the discharge cells for the eight neighboring display lines based on the different weightings. Specifically, the different light emission patterns are observed for the respective driving sequences, as shown below:

light emission pattern shown in FIG. 7 when driving is performed according to the light emission driving sequence of FIG. 6A, light emission pattern shown in FIG. 8 when driving is performed according to the light emission driving sequence of FIG. 6B, light emission pattern shown in FIG. 9 when driving is performed according to the light emission driving sequence of FIG. 6C, light emission pattern shown in FIG. 10 when driving is performed according to the light emission driving sequence of FIG. 6D, light emission pattern shown in FIG. 11 when driving is performed according to the light emission driving sequence of FIG. 6E, light emission pattern shown in FIG. 12 when driving is performed according to the light emission driving sequence of FIG. 6F, light emission pattern shown in FIG. 13 when driving is performed according to the light emission driving sequence of FIG. 6G, and light emission pattern shown in FIG. 14 when driving is performed according to the light emission driving sequence of FIG. 6H.

Next, actual driving operations performed according to an input image signal are described, taking as an example the driving in the first field as shown in FIG. 6A.

Figure 16:
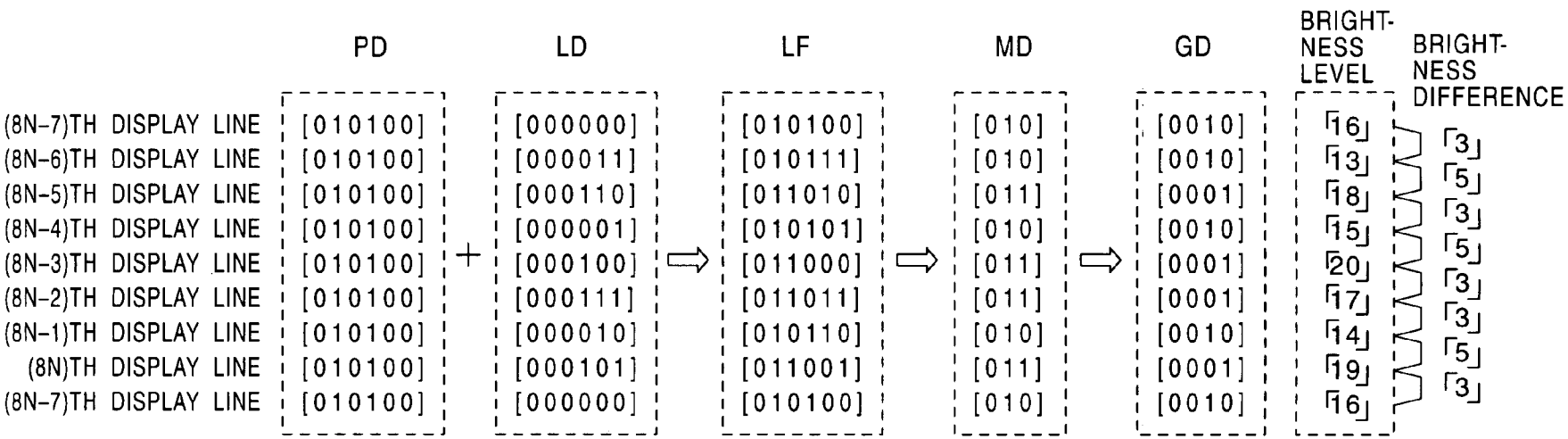
FIG. 16 illustrates line dither processing when pixel data "010100" is supplied; and, FIG. 17 shows changes of weightings of line dithering for each display line.

When the 6-bit pixel data PD corresponding to one column's worth of discharge cells and belonging to one display line is "010100" for all eight neighboring display lines, the line dither offset value generation circuit 21 adds the line dither offset values LD shown in FIG. 4A to the pixel data PD of each display line, as shown in FIG. 16. Through this addition of line dither offset values LD, line offset-added pixel data LF is obtained for each display line, as shown in FIG. 16; that is, for the (8N-7)th display line: data LF is "010100",
for the (8N-6)th display line: data LF is "010111",
for the (8N-5)th display line: data LF is "011010",
for the (8N-4)th display line: data LF is "010101",
for the (8N-3)th display line: data LF is "011000",
for the (8N-2)th display line: data LF is "011011",
for the (8N-1)th display line: data LF is "010110", and
for the (8N)th display line: data LF is "011001".

The lower-bit discard circuit 23 discards the lower 3 bits of each line offset-added pixel data LF, and takes the remaining upper 3 bits as the multi-grayscale pixel data MD. Thus, the multi-grayscale pixel data MD is obtained for the eight neighboring display lines as shown in FIG. 16; that is, for the (8N-7)th display line: data MD is "010",
for the (8N-6)th display line: data MD is "010",
for the (8N-5)th display line: data MD is "011",
for the (8N-4)th display line: data MD is "010",
for the (8N-3)th display line: data MD is "011",
for the (8N-2)th display line: data MD is "011",
for the (8N-1)th display line: data MD is "010", and
for the (8N)th display line: data MD is "011".

Then, the multi-grayscale pixel data MD is converted by the driving data conversion circuit 3 into 5-bit pixel driving data GD, as follows.

for the (8N-7)th display line: data GD is "0010",
for the (8N-6)th display line: data GD is "0010",
for the (8N-5)th display line: data GD is "0001",
for the (8N-4)th display line: data GD is "0010",
for the (8N-3)th display line: data GD is "0001",
for the (8N-2)th display line: data GD is "0001",
for the (8N-1)th display line: data GD is "0010", and
for the (8N)th display line: data GD is "0001".

By means of the light emission driving patterns shown in FIG. 7, the discharge cells belonging to the eight neighboring display lines are driven to emit light at the following brightness levels:

brightness level "16" for the discharge cells positioned in the (8N-7)th display lines;

brightness level "13" for the discharge cells positioned in the (8N-6)th display lines;

brightness level "18" for the discharge cells positioned in the (8N-5)th display lines;

brightness level "15" for the discharge cells positioned in the (8N-4)th display lines;

brightness level "20" for the discharge cells positioned in the (8N-3)th display lines;

brightness level "17" for the discharge cells positioned in the (8N-2)th display lines;

brightness level "14" for the discharge cells positioned in the (8N-1)th display lines; and, brightness level "19" for the discharge cells positioned in the (8N)th display lines.

Here, the average of the brightness levels of the eight display lines is perceived.

As described above, in the plasma display device shown in FIG. 3, different line dither offset values LD are added to pixel data PD of the eight neighboring display lines, and light emission driving is performed with different brightness weightings assigned to the eight neighboring display lines. By means of this driving, so-called line dither processing is performed, causing brightness differences between neighboring display lines.

In the line dither processing of this embodiment, the bias in brightness differences between neighboring display lines in the PDP 100 is rendered approximately uniform. In other words, the bias is restricted to remain within a prescribed value. For example, if "010100" pixel data PD is supplied, as shown in FIG. 16, the brightness difference between the (8N-7)th and (8N-6)th display lines is "3", the brightness difference between the (8N-6)th and (8N-5)th display lines is "5", the brightness difference between the (8N-5)th and (8N-4)th display lines is "3", the brightness difference between the (8N-4)th and (8N-3)th display lines is "5", the brightness difference between the (8N-3)th and (8N-2)th display lines is "3", the brightness difference between the (8N-2)th and (8N-1)th display lines is "3", and the brightness difference between the (8N-1)th and (8N)th display lines is "5", so that the bias in brightness differences is "2".

Similarly when other pixel data values PD are supplied, the bias in brightness differences between neighboring display lines is "2" or less.

For example, according to the light emission driving pattern shown in FIG. 7, the discharge cells belonging to the eight neighboring display lines emit light at the brightness levels of five grayscales, as shown in FIG. 15. In the line dither processing of this invention the line dither offset values LD are added to the pixel data PD, so that when setting a certain display line to kth grayscale driving (k=1,2,3,4,5), the neighboring display lines are set to kth grayscale driving or to (k+1)th grayscale driving. Hence when for example driving the discharge cells positioned in the (8N-7)th display lines to emit light at brightness level "16" by the third grayscale driving, the discharge cells positioned in the (8N-6)th display lines are driven to emit light at brightness level "13" by the third grayscale driving, or to emit light at brightness level "21" by the fourth grayscale driving. Consequently when the discharge cells positioned in the (8N-6)th display lines are driven by the third grayscale driving, the brightness difference between the (8N-6)th and (8N-7)th display lines is "3", and when the discharge cells positioned in the (8N-6)th display lines are driven by the fourth grayscale driving, the brightness difference between the (8N-6)th and (8N-7)th display lines is "5". Thus, the bias in these two values is "2".

In this way, when executing the line dither processing, the bias in brightness differences between neighboring display lines is limited to within a prescribed range, so as to obtain a high-quality dithered display with little unevenness in brightness.

Figure 17:
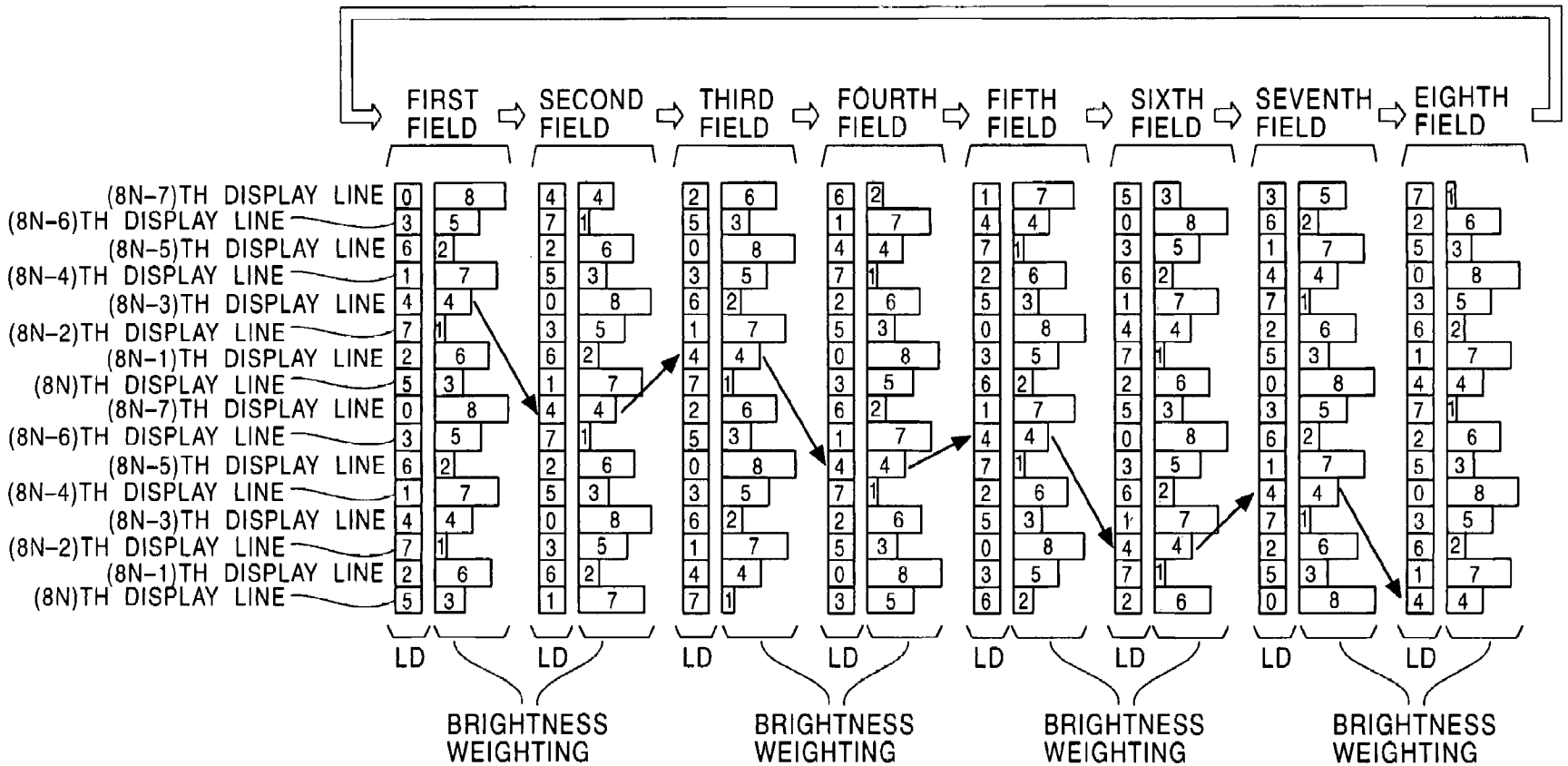

Further, in the line dither processing of this invention the first through eighth fields of the input image signal are taken to be one cycle, and in each field the weighting of line dither processing is changed for each of eight neighboring display lines, as shown in FIG. 17.

In other words, allocations of the first to eighth line dither processing to the display lines are changed for each field.

The first line dither processing adds a "0" line dither offset value LD to the pixel data PD in addition to performing light emission corresponding to a brightness weighting of "8".

The second line dither processing adds a "1" line dither offset value LD to the pixel data PD in addition to performing light emission corresponding to a brightness weighting of "7".

The third line dither processing adds a "2" line dither offset value LD to the pixel data PD in addition to performing light emission corresponding to a brightness weighting of "6";

The fourth line dither processing adds a "3" line dither offset value LD to the pixel data PD in addition to performing light emission corresponding to a brightness weighting of "5";

The fifth line dither processing adds a "4" line dither offset value LD to the pixel data PD in addition to performing light emission corresponding to a brightness weighting of "4";

The sixth line dither processing adds a "5" line dither offset value LD to the pixel data PD in addition to performing light emission corresponding to a brightness weighting of "3";

The seventh line dither processing adds a "6" line dither offset value LD to the pixel data PD in addition to performing light emission corresponding to a brightness weighting of "2"; and, The eighth line dither processing adds a "7" line dither offset value LD to the pixel data PD in addition to performing light emission corresponding to a brightness weighting of "1".

In the first field as shown in FIG. 17, the first through eighth line dither processing is allocated to the display lines as follows:

(8N-7)th display lines: 1st line dither processing;
(8N-6)th display lines: 4th line dither processing;
(8N-5)th display lines: 7th line dither processing;
(8N-4)th display lines: 2nd line dither processing;
(8N-3)th display lines: 5th line dither processing;
(8N-2)th display lines: 8th line dither processing;
(8N-1)th display lines: 3rd line dither processing; and,
(8N)th display lines: 6th line dither processing.

In the second field, the first through eighth line dither processing is allocated to the display lines as follows:

(8N-7)th display lines: 5th line dither processing;
(8N-6)th display lines: 8th line dither processing;
(8N-5)th display lines: 3rd line dither processing;
(8N-4)th display lines: 6th line dither processing;
(8N-3)th display lines: 1st line dither processing;
(8N-2)th display lines: 4th line dither processing;
(8N-1)th display lines: 7th line dither processing; and,
(8N)th display lines: 2nd line dither processing.

In the third field, the first through eighth line dither processing is allocated to the display lines as follows:

(8N-7)th display lines: 3rd line dither processing;
(8N-6)th display lines: 6th line dither processing;
(8N-5)th display lines: 1st line dither processing;
(8N-4)th display lines: 4th line dither processing;
(8N-3)th display lines: 7th line dither processing;
(8N-2)th display lines: 2nd line dither processing;
(8N-1)th display lines: 5th line dither processing; and,
(8N)th display lines: 8th line dither processing.

In the fourth field, the first through eighth line dither processing is allocated to the display lines as follows:

(8N-7)th display lines: 7th line dither processing;
(8N-6)th display lines: 2nd line dither processing;
(8N-5)th display lines: 5th line dither processing;
(8N-4)th display lines: 8th line dither processing;
(8N-3)th display lines: 3rd line dither processing;
(8N-2)th display lines: 6th line dither processing;
(8N-1)th display lines: 1st line dither processing; and,
(8N)th display lines: 4th line dither processing.

In the fifth field, the first through eighth line dither processing is allocated to the display lines as follows:

(8N-7)th display lines: 2nd line dither processing;
(8N-6)th display lines: 5th line dither processing;
(8N-5)th display lines: 8th line dither processing;
(8N-4)th display lines: 3rd line dither processing;
(8N-3)th display lines: 6th line dither processing;
(8N-2)th display lines: 1st line dither processing;
(8N-1)th display lines: 4th line dither processing; and,
(8N)th display lines: 7th line dither processing.

In the sixth field, the first through eighth line dither processing is allocated to the display lines as follows:

(8N-7)th display lines: 6th line dither processing;
(8N-6)th display lines: 1st line dither processing;
(8N-5)th display lines: 4th line dither processing;
(8N-4)th display lines: 7th line dither processing;
(8N-3)th display lines: 2nd line dither processing;
(8N-2)th display lines: 5th line dither processing;
(8N-1)th display lines: 8th line dither processing; and,
(8N)th display lines: 3rd line dither processing.

In the seventh field, the first through eighth line dither processing is allocated to the display lines as follows:
(8N-7)th display lines: 4th line dither processing;
(8N-6)th display lines: 7th line dither processing;
(8N-5)th display lines: 2nd line dither processing;
(8N-4)th display lines: 5th line dither processing;
(8N-3)th display lines: 8th line dither processing;
(8N-2)th display lines: 3rd line dither processing;
(8N-1)th display lines: 6th line dither processing; and,
(8N)th display lines: 1st line dither processing.

In the eighth field, the first through eighth line dither processing is allocated to the display lines as follows:
(8N-7)th display lines: 8th line dither processing;
(8N-6)th display lines: 3rd line dither processing;
(8N-5)th display lines: 6th line dither processing;
(8N-4)th display lines: 1st line dither processing;
(8N-3)th display lines: 4th line dither processing;
(8N-2)th display lines: 7th line dither processing;
(8N-1)th display lines: 2nd line dither processing; and,
(8N)th display lines: 5th line dither processing.

In this embodiment, each line dither processing is applied to upper and lower display lines alternately in the screen, as the field proceeds.

For example, in FIG. 17 the fifth line dither processing, in which a line dither offset value LD of "4" is added to the pixel data PD and light emission driving is performed with a brightness weighting of "4" is allocated to the (8N-3)th display line in the first field. But in the second field, the fifth line dither processing is performed on the (8N-7)th display line, positioned lower than the (8N-3)th display line in the screen, as indicated by the arrow. In the third field the fifth line dither processing is performed on the (8N-1)th display line, positioned higher than the (8N-7)th display line, as indicated by the arrow. In the fourth field, the fifth line dither processing is performed on the (8N-5)th display line, positioned lower than the (8N-1)th display line. In the fifth field, the fifth line dither processing is performed on the (8N-6)th display line, positioned higher than the (8N-5)th display line, as indicated by the arrow. In the sixth field, the fifth line dither processing is performed on the (8N-2)th display line, positioned lower than the (8N-6)th display line, as indicated by the arrow. In the seventh field, the fifth line dither processing is performed on the (8N-4)th display line, positioned higher than the (8N-2)th display line, as indicated by the arrow. In the eighth field, the fifth line dither processing is performed on the (8N)th display line, positioned lower than the (8N-4)th display line, as indicated by the arrow.

Consequently, even if a viewer of the image displayed on the screen of the PDP 100 shifts his gaze within the screen, the possibility of continuously looking at pixels emitting light at the same brightness is lessened, and so a satisfactory dithered display, in which pseudo-contours are not readily perceived, is realized.

In the above described embodiment, the display lines are divided into eight display line groups at every eight lines, and correspondingly, subfields SF(k) are divided into eight lower-level subfields $SF(k)_1$ to $SF(k)_8$, to execute eight-line dither processing; however, the number of divisions is not limited to eight, but may be four or six divisions, or similar. For example, in the case of four divisions, the display lines are divided into four display line groups at every four lines, as shown below:
(4N-3)th display line group,
(4N-2)th display line group,
(4N-1)th display line group, and
(4N)th display line group,
and subfields SF(k) are divided into four subfields $SF(k)_1$ to $SF(k)_4$ corresponding to these, to perform four-line dither processing. In this case, line dither offset values are set to four different values.

This application is based on a Japanese Patent Application No. 2003-178113 filed on Jun. 23, 2003, and the entire disclosure thereof is incorporated herein by reference.

What is claimed is:

1. A driving device which drives a display panel according to pixel data derived from an input image signal, the display panel including pixel cells serving as pixels, positioned in a plurality of display lines,
wherein said plurality of display lines are divided into a plurality of display line groups, each group including a plurality of neighboring display lines,
wherein said driving device comprises a light emission driving circuit which causes the pixel cells in each of said neighboring display lines in the respective display line groups to emit light at different brightness levels based on weighting values assigned to said plurality of display lines, and
wherein said weighting values are assigned to said plurality of display lines such that bias in brightness differences between said pixel cells positioned in neighboring display lines is within a prescribed range for all neighboring display lines in said display panel,
the driving device for a display panel further comprising weighting alteration means which alters, at each of prescribed periods, assignment of said weighting values to the display lines in said display line group.

2. The driving device for a display panel according to claim 1, wherein said weighting alteration means alters the assignment of said weighting values such that a first weighting value assigned to a first display line among said display line group is assigned to a second display line above the first display line in said display line group at said prescribed period, and then assigned to a third display line below the second display line in said display line group at next said prescribed period, or such that the first weighting value is assigned to a second display line below the first display line in said display line group at said prescribed period, and then assigned to a third display line above the second display line in said display line group at next said prescribed period.

3. A driving device which drives a display panel according to pixel data derived from an input image signal, the display panel including pixel cells serving as pixels, positioned in a plurality of display lines,
wherein said plurality of display lines are divided into a plurality of display line groups, each group including a plurality of neighboring display lines,
wherein said driving device comprises a light emission driving circuit which causes the pixel cells in each of said neighboring display lines in the respective display line groups to emit light at different brightness levels based on weighting values assigned to said plurality of display lines, and
wherein said weighting values are assigned to said plurality of display lines such that bias in brightness differences between said pixel cells positioned in neighboring display lines is within a prescribed range for all neighboring display lines in said display panel, the driving device for a display panel further comprising adding means to assign different line offset values to the display lines in said display line group and to add, to said pixel data corresponding to each of said pixel cells positioned in each of the display lines in said display line group, a corresponding one of said line offset values, to obtain line offset-added pixel data; and, said light emission driving means causes each of the pixel cells positioned in each of the display lines within said display line group to emit light at different brightness levels, based on said line offset-added pixel data and said weighting values assigned to the display line concerned.

4. A method of grayscale-driving a display panel based on pixel data derived from an input image signal, the display panel including a plurality of display lines, with a plurality of pixel cells serving as pixels being arranged on each of the plurality of display lines, the plurality of display lines being divided into L groups by taking every L display lines, each single field display period of the input image signal being divided into a plurality of subfields, the method comprising:

setting the subfields into a lit mode and an unlit mode in K different manners so as to define first to Kth grayscale driving levels, each grayscale driving level including L brightness levels so that different brightness levels can be allocated to the display lines belonging to the respective display line groups for every said grayscale driving level; and driving the display panel in accordance with the first to Kth grayscale driving levels.

5. A method of grayscale-driving a display panel based on pixel data derived from an input image signal, the display panel including a plurality of display lines, with a plurality of pixel cells serving as pixels being arranged on each of the plurality of display lines, the plurality of display lines being divided into a plurality of groups, each display line group consisting of a predetermined number of neighboring display lines, each single field display period of the input image signal being divided into a plurality of subfields, the method comprising:

setting the subfields into a lit mode and an unlit mode in K different manners so as to define first to Kth grayscale driving levels, each grayscale driving level including the same number of brightness levels as the number of display lines in each said display line group so that different brightness levels can be allocated to the display lines in the display line group for every said grayscale driving level; and driving the display panel in accordance with the first to Kth grayscale driving levels.

* * * * *